US006851992B2

(12) United States Patent
Matsuo

(10) Patent No.: US 6,851,992 B2
(45) Date of Patent: Feb. 8, 2005

(54) COOLING SYSTEM FOR JET PROPULSION BOAT

(75) Inventor: Hisashi Matsuo, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/263,769

(22) Filed: Oct. 4, 2002

(65) Prior Publication Data

US 2003/0148678 A1 Aug. 7, 2003

(30) Foreign Application Priority Data

Feb. 4, 2002 (JP) ..... 2002-027476

(51) Int. Cl.[7] ..... F01P 7/14
(52) U.S. Cl. ..... 440/88 C; 123/41.08
(58) Field of Search ..... 440/88 R, 88 C, 440/88 D, 88 G, 88 J, 88 M; 123/41.08

(56) References Cited

U.S. PATENT DOCUMENTS 3,323,502 A * 6/1967 Whalen ..... 123/41.08
4,457,727 A * 7/1984 Flaig ..... 440/88 R
4,669,988 A * 6/1987 Breckenfeld et al. ..... 440/88 R
5,038,724 A * 8/1991 Neal et al. ..... 123/41.08
5,261,356 A * 11/1993 Takahashi et al. ..... 123/41.31
5,531,620 A * 7/1996 Ozawa et al. ..... 440/89 R
5,937,801 A * 8/1999 Davis ..... 123/41.33
6,312,300 B1 * 11/2001 Asai ..... 440/88 R
6,331,127 B1 * 12/2001 Suzuki ..... 440/88 R
6,368,169 B1 * 4/2002 Jaeger ..... 440/88 R

FOREIGN PATENT DOCUMENTS

JP 10-238358 9/1998

* cited by examiner

*Primary Examiner*—Andrew D. Wright
(74) *Attorney, Agent, or Firm*—Birch, Stewart, Kolasch & Birch, LLP

(57) ABSTRACT

To provide a cooling system for a jet propulsion boat in which the number of components are reduced and the construction is simplified. A cooling system for a jet propulsion boat is a system in which a jet propulsion unit is provided at a rear portion of the vessel body. The jet propulsion unit is driven by the engine to emit a jet of water for propelling the boat. The engine is cooled by flowing a part of the jet of water in the engine-cooling flow path as cooling water. The cooling system for a jet propulsion boat comprises a constantly opened flow path having a constant cross sectional area and a flow regulating valve that opens the valve body when the primary pressure exceeds a prescribed value. The opening of the opened valve body is varied according to the primary pressure in the engine-cooling flow path.

26 Claims, 13 Drawing Sheets

COOLING SYSTEM FOR JET PROPULSION BOAT

CROSS-REFERENCE TO RELATED APPLICATIONS

This nonprovisional application claims priority under 35 U.S.C. § 119(a) on Patent Application No. 2002-027476 filed in Japan on Feb. 4, 2002, the entirety of which is hereby incorporated by reference.

BACKGROUND OF THE INVENTION

1. Field of the Invention

The present invention relates to a cooling system for a jet propulsion boat wherein a jet of water for propelling the boat is emitted by driving a jet propulsion unit with an engine. In particular, a part of the jet of water from the jet propulsion unit is utilized for cooling the engine.

2. Description of Background Art

A jet propulsion boat is a vessel provided with a jet propulsion unit mounted at a rear portion of the vessel body. The jet propulsion boat is propelled by sucking water from the vessel bottom by driving the jet propulsion unit by the engine. The sucked water is then emitted rearward as a jet of water. Such a jet propulsion boat is provided with a cooling system for cooling the engine or the exhaust system while being propelled.

A cooling system for a jet propulsion boat is known from, for example, JP-A-10-238358 entitled "FOUR-CYCLE ENGINE AND SMALL PLANING BOAT HAVING THE SAME." The contents of the above publication are illustrated in FIG. 13 of the present invention and the cooling system of the jet propulsion boat will be described below.

FIG. 13 is a general view showing a principal portion of the cooling system for a jet propulsion boat according to the background art. The jet propulsion boat 150 is provided with an engine-cooling flow path 152 for cooling the engine 151. The engine-cooling flow path 152 includes an inlet path 153 through which a part of the jet of water is taken as cooling water. The inlet path 153 is connected to the engine-cooling duct (for example, a jacket water). The engine-cooling duct is provided with a thermostat valve 155 and a relief valve 156 at the rear end portion 154 thereof. The engine-cooling duct is further provided with a constantly opened drainage duct 157 and a relief drainage duct 158 at the rear end portion thereof.

The engine-cooling flow path 152 is a flow path constructed in such a manner that a part of the jet of water emitted from the jet propulsion unit 160 is taken as cooling water by facing the inlet port 153*a* of the inlet path 153 toward the interior of the jet propulsion unit 160. Cooling water taken therein is introduced into the engine-cooling duct. Furthermore, the cooling water introduced into the engine-cooling duct is discharged from the constantly opened drainage duct 157 as shown by the arrow a.

According to the jet propulsion boat 150, the jet propulsion boat 150 is propelled by driving the engine 151 and thereby rotating blades 161 of the jet propulsion unit 160, and emitting a jet of water from the steering nozzle 162.

In this case, a part of the jet of water emitted by the jet propulsion unit 160 is taken through the inlet port 153*a* of the inlet path 153 as cooling water. The cooling water taken therethrough is introduced into the engine-cooling duct. Furthermore, the engine 151 is then cooled by the cooling water thus introduced. After the engine 151 is cooled, the cooling water is discharged from the constantly opened drainage duct 157 toward the outside as shown by the arrow a.

When the temperature of the cooling water exceeds a threshold value while cooling the engine 151, the thermostat valve 155 opens and discharges the cooling water through the relief drainage duct 158 as shown by the arrow b. Accordingly, the cooling water flowing in the engine-cooling flow path 152 is kept at a preferable temperature.

When the hydraulic pressure of the cooling water exceeds a threshold value, a relief valve 156 opens and discharges the cooling water through the relief drainage duct 157 as shown by the arrow b. Accordingly, the cooling water flowing in the engine-cooling flow path 152 is kept at a preferable hydraulic pressure.

In this way, providing the thermostat valve 155 and the relief valve 156 in the engine-cooling flow path 152 enables to cool the engine 151 while maintaining cooling water in the preferable state in terms of temperature and hydraulic pressure.

However, the engine-cooling system of the jet propulsion boat 150 in the background art requires the thermostat valve 155 and the relief valve 156 for maintaining the temperature and the hydraulic pressure of the cooling water in the preferable state. In addition, the background art requires two drainage ducts including the constantly opened drainage duct 157 and the relief drainage duct 158 for draining the cooling water. Therefore, the number of components of the engine-cooling flow path 152 increases, which hinders reduction of the cost. Furthermore, increasing the number of components makes the structure complex, and thus it takes time for assembling the engine-cooling system of the jet propulsion boat 150, which hinders increase an in productivity.

SUMMARY OF THE INVENTION

Accordingly, it is an object of the present invention to provide a cooling system for a jet propulsion boat in which the number of components is reduced to simplify the structure.

In order to achieve the aforementioned object, according to a first aspect of the present invention, a jet propulsion boat includes a jet propulsion unit provided at the rear portion of the vessel body. The jet propulsion unit is driven by the engine to emit a jet of water for propelling the boat. The engine is cooled by flowing a part of the jet of water in the engine-cooling flow path as cooling water. The engine-cooling flow path is provided with a constantly opened flow path having a constant cross sectional area and a flow regulating valve that opens a valve body when a primary pressure exceeds a prescribed value. Furthermore, the cross sectional area of the engine-cooling flow path is varied by varying the opening of the opened valve body according to the primary pressure.

In general, the jet propulsion boat uses a part of the jet of water emitted from the jet propulsion unit as cooling water to flow into the engine-cooling flow path. Since the quantity of a jet of water varies according to the number of engine revolutions, the quantity of cooling water can be varied in accordance with the number of engine revolutions.

However, it is considered to be difficult to cool the engine sufficiently over the entire range of engine revolutions between when the engine is idling (when the engine is in the idle state) and when the engine is at full power (when the engine is running at full power) when using a part of the jet of water as the cooling water.

More specifically, when the quantity of cooling water is determined, the quantity of cooling water is determined corresponding to the number of engine revolutions during travel at full power. It is known that when the quantity of cooling water is determined in such a manner, the engine may be brought into a state of being excessively cooled, that is, the over-cooled state as the number of engine revolution is reduced and comes closer to the state of driving at idle.

Therefore, according to the first aspect of the present invention, the engine-cooling flow path is provided with a constantly opened flow path with a constant cross sectional area. A flow regulating valve opens when the primary pressure exceeds a prescribed value and the opening of which varies in accordance with a primary pressure. As is described above, with the provision of the constantly opened flow path having a constant cross sectional area in the engine-cooling flow path, cooling water flows through the constantly opened flow path so that a relatively small quantity of cooling water flown into the engine-cooling flow path in the region close to a state in which the engine is running at idle.

As a consequence, overcooling of the engine in the region in which the number of engine revolution is relatively small such as when the engine is idling (hereinafter referred to as "low-revolution region") is prevented. Accordingly, the engine is sufficiently cooled.

On the other hand, with the provision of the flow regulating valve in the engine-cooling flow path, the valve body is opened when the primary pressure exceeds a prescribed value, and the opening of opened valve body varies in accordance with the primary pressure.

The terms "the primary pressure exceeds a prescribed value" mean that the number of engine revolutions is relatively large. In other words, the primary pressure increases to the value exceeding a prescribed value by increasing the number of engine revolutions to the relatively high value and thus increasing the hydraulic pressure of a jet of water from the jet propulsion unit.

As a consequence, in the region in which the number of engine revolutions is relatively large (hereinafter referred to as "high-revolution region"), a relatively large quantity of cooling water can flow by opening the flow regulating valve. Flowing a relatively large quantity of cooling water enables an adequate quantity of cooling water corresponding to the heat release value of the engine, whereby the engine is sufficiently cooled.

As is described thus far, with a simple structure in which only the constantly opened flow path and the flow regulating valve are provided in the engine-cooling flow path, a sufficient quantity of cooling water can flow corresponding to the respective heat release values in the low-revolution region and the high-revolution region.

According to a second aspect of the present invention, the constantly opened flow path is provided in the valve body of the flow regulating valve.

Since the constantly opened flow path is provided in the valve body of the flow regulating valve, the constantly opened flow path may be assembled within the flow regulating valve, and thus it is not necessary to provide separate constantly opened flow paths as individual other than in the flow regulating valve.

In addition, integrating the constantly opened flow path in the flow regulating valve enables cooling water passed through the constantly opened flow path to be drained using the drainage duct of the flow regulating valve. As a consequence, the drainage duct of the constantly opened flow path can be commonly used as the drainage duct of the flow regulating valve.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
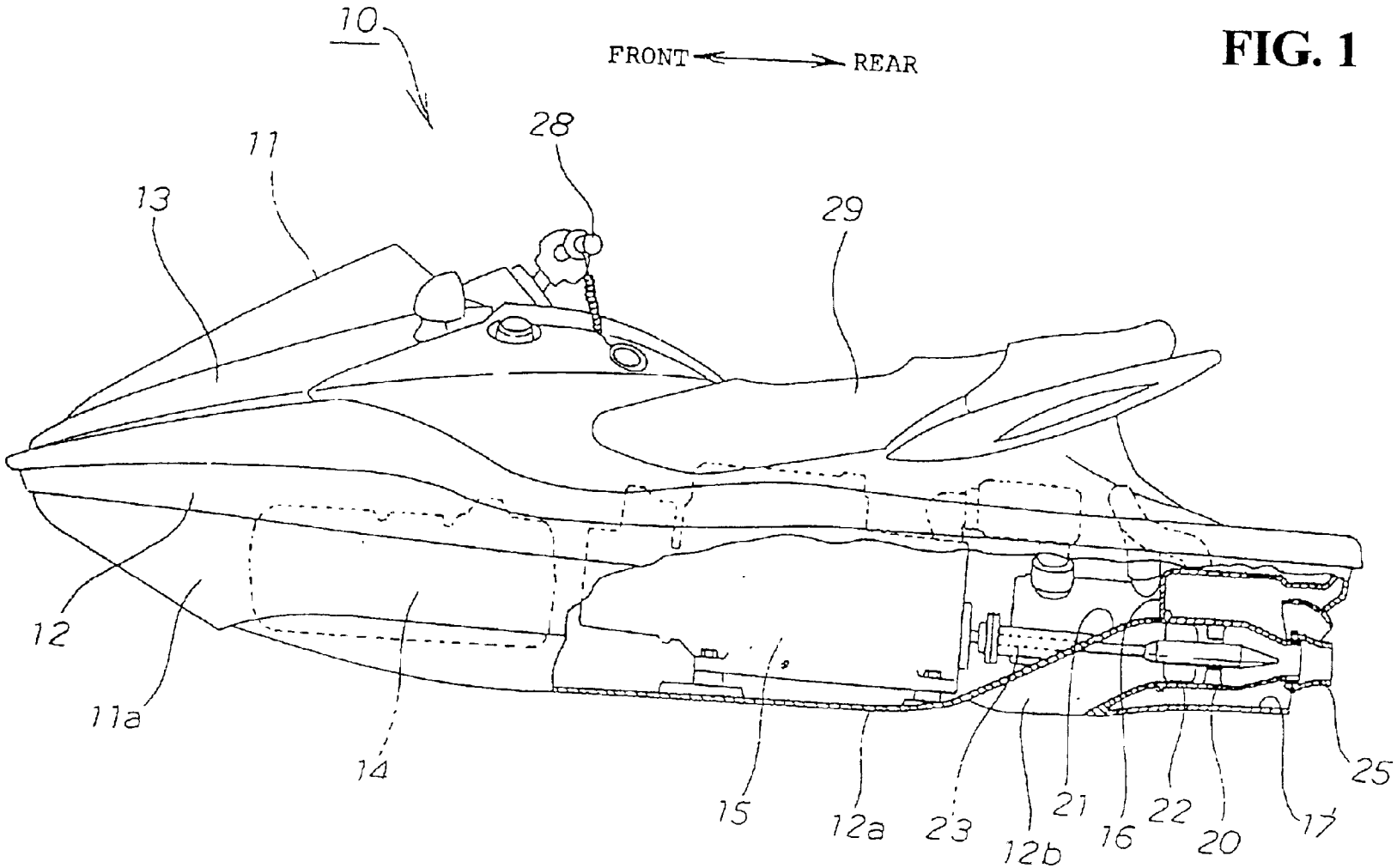
FIG. 1 is a side view of a jet propulsion boat provided with a cooling system according to the present invention.

Referring now to the attached drawings, an embodiment of the present invention will be described below. The drawings are to be viewed in the direction of orientation of the reference numerals. FIG. 1 is a side view of a jet propulsion boat provided with a cooling system according to the present invention.

The jet propulsion boat 10 according to the present invention includes a vessel body 11 constructed by attaching a deck 13 to the hull 12. A fuel tank 14 is mounted at the front portion 11*a* of the vessel body 11. An engine 15 is provided rearwardly of the fuel tank 14. A jet pump chamber 16 is provided rearwardly of the engine 15. A jet propulsion unit (that is, a jet pump) 20 is provided in the jet pump chamber 16. A steering handle 28 is disposed above the fuel tank 14. A saddle-riding type seat 29 is mounted rearwardly of the steering handle 28. In addition, the jet propulsion boat includes a cooling system, which will be described below.

The jet propulsion unit 20 includes a housing 21 extending rearward from the opening 12*b* of the vessel bottom 12*a* that constitutes the hull 12. An impeller 22 is rotatably mounted in the housing 21. The impeller 22 is connected to the drive shaft 23 of the engine 15.

The jet propulsion unit 20 emits water sucked from the opening 12*b* of the vessel bottom 12*a* as a jet of water through the housing 21 from the steering nozzle 25 by driving the engine 15 and thereby rotating the impeller 22. Arranging the steering nozzle 25 at the rear end opening 17 of the jet pump chamber 16 enables a jet of water to be emitted from the steering nozzle 25 rearwardly of the vessel body 11 through the rear end opening 17 of the jet pump chamber 16.

The steering nozzle 25 is a nozzle mounted at the rear end of the housing 21 so as to be capable of a swinging motion in the lateral direction. The steering nozzle 25 is a nozzle for controlling the steering direction of the vessel body 11 by operating the steering handle 28 so as to swing in the lateral direction.

The jet propulsion boat 10 can be propelled by supplying fuel from the fuel tank 14 to the engine 15 to drive the engine 15, transmitting a driving force of the engine 15 to the impeller 24 via the drive shaft 23, sucking water from the opening 12*b* of the vessel bottom 12*a* by rotating the impeller 24, and emitting the sucked water through the rear end of the housing 21 from the steering nozzle 25 as a jet of water.

Figure 2:
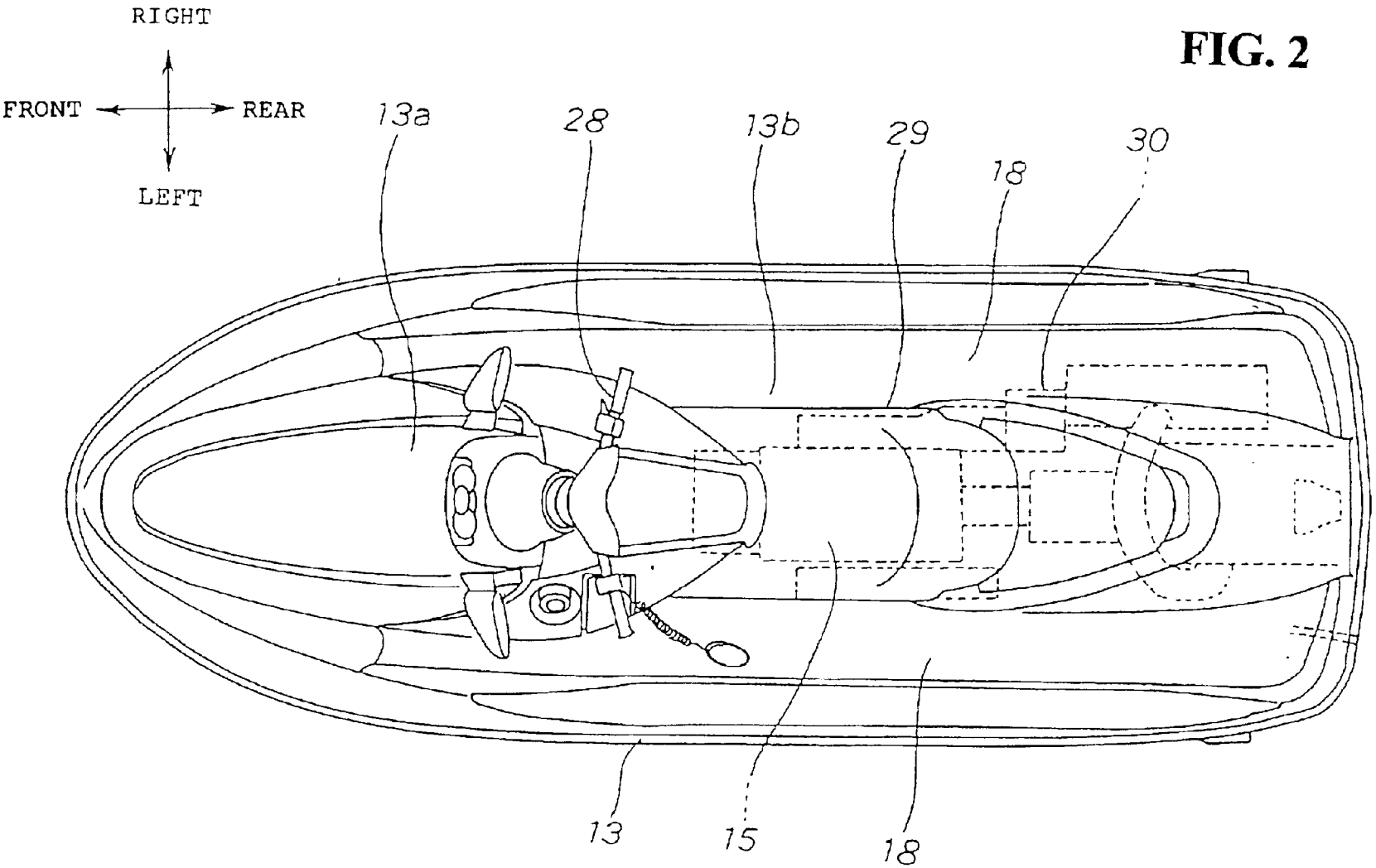
FIG. 2 is a plan view of the jet propulsion boat provided with the cooling system according to the present invention.

FIG. 2 is a plan view of a jet propulsion boat provided with a cooling system according to the present invention. In FIG. 2, a steering handle 28 is provided on the upper front portion 13*a* of the deck 13. A saddle-riding type seat 29 extending in the fore-and-aft direction is provided at the center 13*b* on the upper surface of the deck 13 (lateral center) rearwardly of the steering handle 28. Foot-rest deck portions 18 are provided on the left and right of the saddle-riding type seat 29. An engine 15 and an exhaust system 30 are provided in the vessel body 11. Furthermore, a cooling system (to be described below) for a jet propulsion boat for cooling the engine 15 and the exhaust system 30 are provided.

Figure 3:
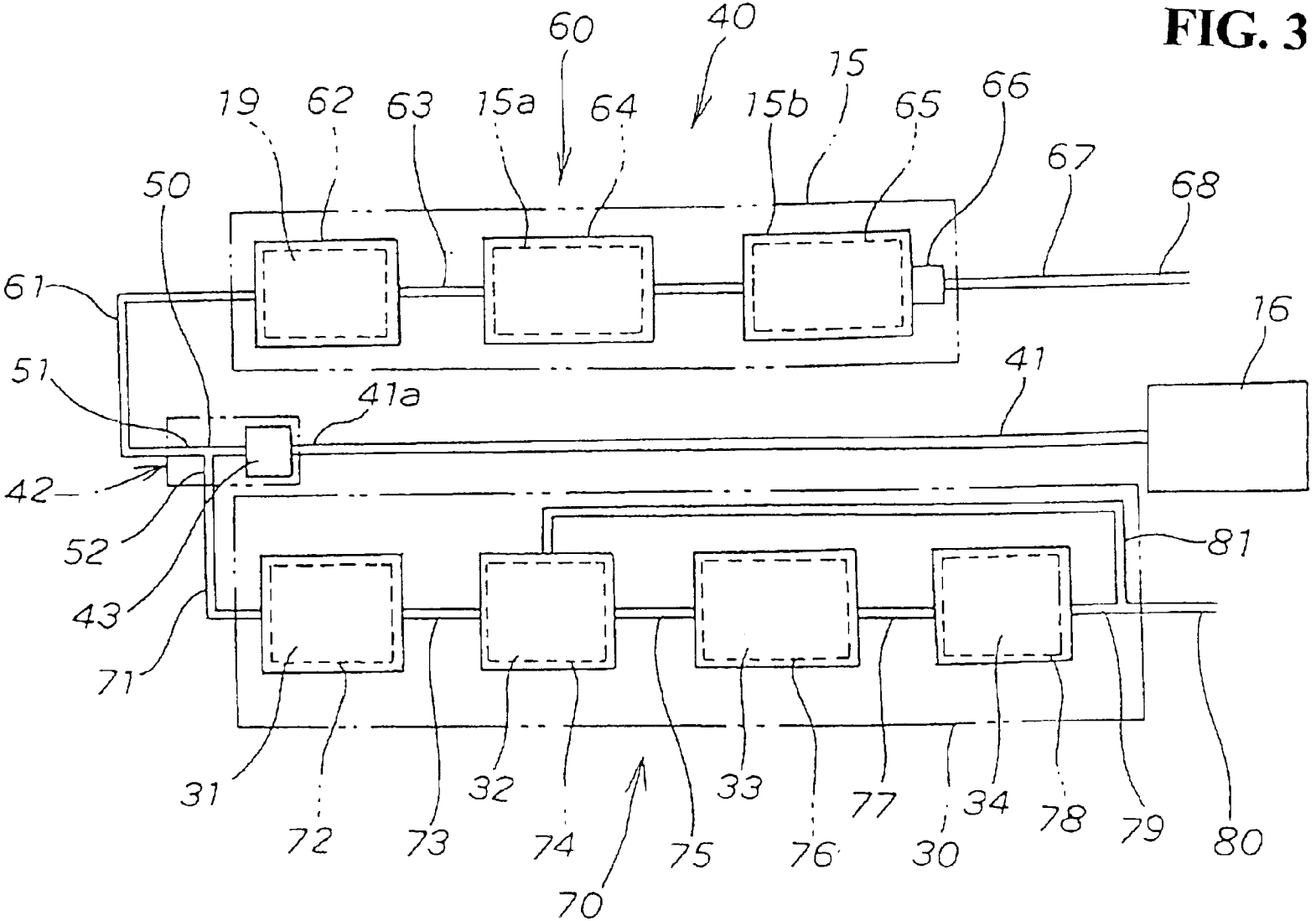
FIG. 3 is a block diagram of the cooling system for a jet propulsion boat according to the present invention.

FIG. 3 is a block diagram of the cooling system for a jet propulsion boat according to the present invention. The cooling system 40 for a jet propulsion boat takes a part of the jet of water emitted from the jet propulsion unit 20 (shown in FIG. 1) into the inlet path 41 as cooling water. The cooling water taken into the inlet path 41 then diverges at the diverging path 50 of the one-way valve unit 42 toward the engine-cooling flow path 60 and the exhaust-system-cooling flow path 70 so that the engine 15 is cooled. Simultaneously, the exhaust system 30 is cooled.

The inlet path 41 is provided with the one-way valve unit 42 at the outlet port 41*a* thereof. The one-way valve unit 42 includes a one-way valve 43 on the side of the inlet path 41, and provides a diverging path 50 integrally on the opposite side of the inlet path 41.

The engine-cooling flow path 60 is connected to the first diverged outlet port 51 diverged by the diverging path 50. The exhaust-system-cooling flow path 70 is connected to the second diverged outlet port 52 diverged by the diverging path 50.

The engine-cooling flow path 60 is constructed in such a manner that the first diverged outlet port 51 is connected to the feed port of the oil-cooler-cooling duct (cooling water jacket) 62 through the first engine-cooling flow path 61. The outlet port of the oil-cooler-cooling duct 62 is connected to the feed port of the cylinder-block-cooling duct (cooling water jacket) 64 through the second engine-cooling flow path 63. The outlet port of the cylinder-block-cooling duct 64 is connected to the feed port of the cylinder head cooling duct (cooling water jacket) 65. The outlet port of the cylinder head cooling duct 65 is connected to the flow regulating valve 66. The flow regulating valve 66 is connected to the intake port of the drainage duct 67 for engine-cooling water. The cooling water drainage port 68 of the drainage duct 67 faces toward the interior of the jet pump chamber 16 (See FIG. 1).

The exhaust-system-cooling flow path 70 is constructed in such a manner that the second diverged outlet port 52 is connected to the feed port of the inter-cooler-cooling duct (cooling water jacket) 72 via the first exhaust-system-cooling flow path 71. The outlet port of the intercooler-cooling duct 72 is connected to the feed port of the exhaust-manifold-cooling duct (cooling water jacket) 74 via the second exhaust-system-cooling flow path 73. The outlet port of the exhaust-manifold-cooling duct 74 is connected to the feed port of the turbocharger-cooling duct (cooling water jacket )76 via the third exhaust-system-cooling flow path 75. The outlet port of the turbocharger-cooling duct 76 is connected to the feed port of the exhaust-pipe cooling duct (cooling water jacket) 78 via the fourth exhaust-system-cooling flow path 77. The intake port of the drainage duct 79 for exhaust-system-cooling water is connected to the outlet port of the exhaust-pipe-cooling duct 78. Furthermore, a cooling water drainage port 80 at the rear end 79*b* of the drainage duct 79 is provided on the rear surface 11*b* of the vessel body 11. Reference numeral 81 is a by-pass flow path for adjusting the volumetric flow of cooling water to the preferable quantity.

Figure 4:
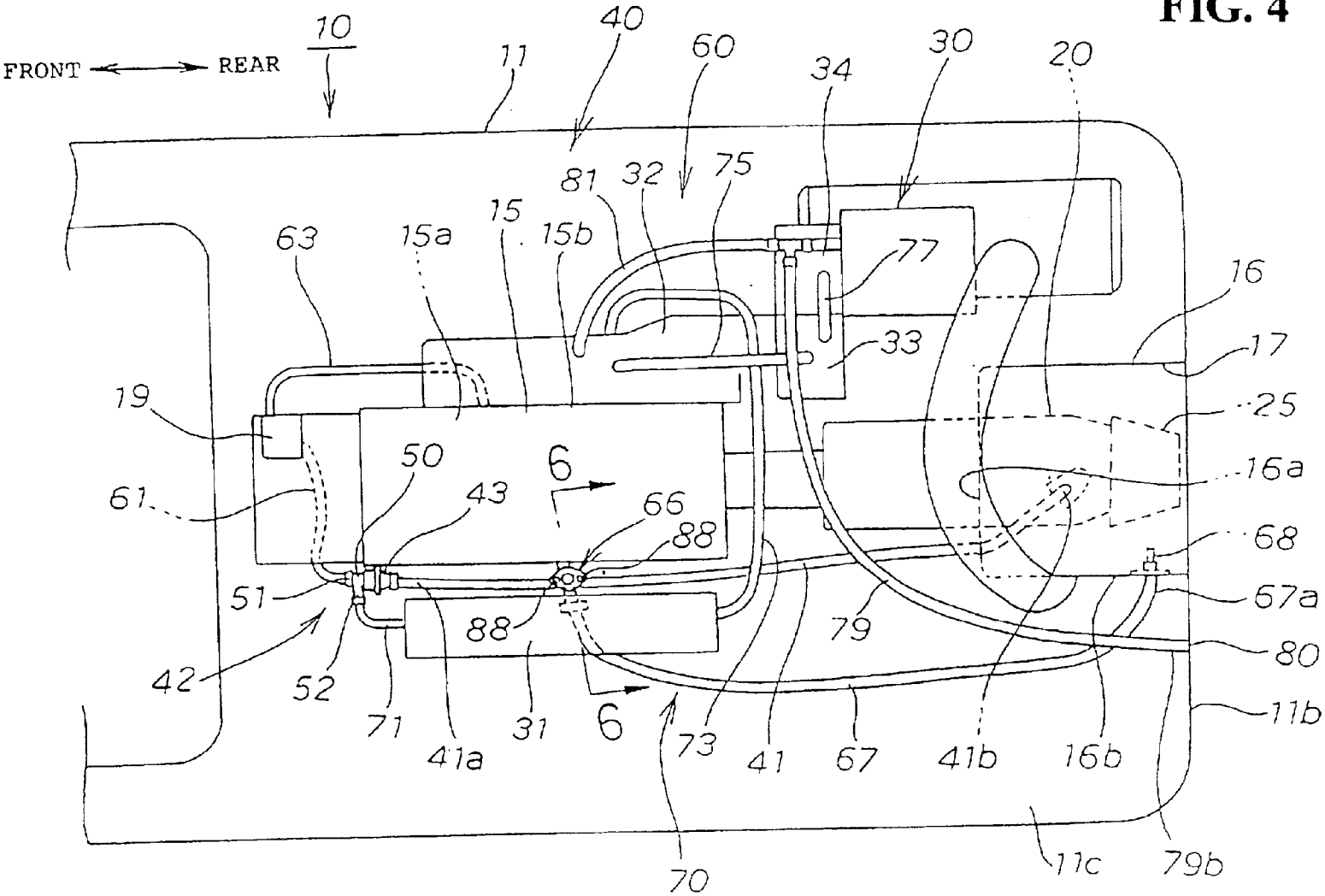
FIG. 4 is a plan view of the cooling system for a jet propulsion boat according to the present invention.

FIG. 4 is a plan view of the cooling system for a jet propulsion boat according to the present invention, showing a state in which the jet pump chamber 16 is provided at the rear portion 11*c* of the vessel body 11. The jet propulsion unit 20 is provided in the jet pump chamber 16. The engine 15 is provided forwardly of the jet propulsion unit 20. The drive shaft 23 (shown in FIG. 1) of the engine 15 is connected to the jet propulsion unit 20. Furthermore, the steering nozzle 25 of the jet propulsion unit 20 faces toward the rear end opening 17 of the jet pump chamber 16.

The jet propulsion boat 10 can be propelled by emitting a jet of water from the steering nozzle 25 by driving the jet propulsion unit 20 with the engine 15, and emitting the jet of water from the rear end opening 17 of the jet pump chamber 16 rearwardly of the vessel body 11.

In this case, a part of the jet of water emitted from the jet propulsion unit 20 is introduced into the inlet path 41 as cooling water. The cooling water introduced into the inlet path 41 is diverged at the diverging path 50 of the one-way valve unit 42 toward the engine-cooling flow path 60 and the exhaust-system-cooling flow path 70. Accordingly, the engine 15 and the exhaust system 30 are respectively cooled.

The inlet path 41 is mounted on the front wall 16*a* of the jet pump chamber 16 at the rear end 41*a* and connected to the jet propulsion unit 20 at the rear end (that is, the jet of water intake port) 41*b*. The inlet path 41 extends along the left side surface of the jet propulsion unit 20 and the left side surface of the engine 15 toward the front. The outlet port at the front end 41*a* thereof is disposed in the vicinity of the front end of the engine 15.

The one-way valve unit 42 is provided at the front end 41*a* of the inlet path 41. The one-way valve unit 42 is provided with the one-way valve 43 on the side of the inlet path 41, and is provided integrally with a diverging path 50 on the opposite side of the inlet path 41.

The engine-cooling flow path 60 is connected to the first diverged outlet port 51 diverged by the diverging path 50. The exhaust-system-cooling flow path 70 is connected to the second diverged outlet port 52 diverged by the diverging path 50.

The engine-cooling flow path 60 is constructed in such a manner that the first diverged outlet port 51 is connected to the cooling duct for the oil cooler 19 via the first engine-cooling flow path 61. The cooling duct for the oil cooler 19 is connected to the cooling duct for the cylinder block 15*a* via the second engine-cooling flow path 63. The cooling duct for the cylinder block 15*a* is connected to the cooling duct for the cylinder head 15*b*. The cooling duct for the cylinder head 15*b* is connected to the flow regulating valve 66. The flow regulating valve 66 is connected to the intake port of the drainage duct 67 for engine cooling water. Furthermore, the rear end 67*a* of the drainage duct 67 is mounted on the left side wall 16*b* of the jet pump chamber 16. Accordingly, the outlet port 68 for the cooling water at the rear end 67*a* faces toward the interior of the jet pump chamber 16, and is disposed in the vicinity of the rear end opening 17 of the jut pump chamber 16.

The exhaust-system-cooling flow path 70 is constructed in such a manner that the cooling duct for the intercooler 31 is connected to the second diverged outlet port 52 via the first exhaust-system-cooling flow path 71. The cooling duct for the intercooler 31 is connected to the cooling duct for the exhaust manifold 32 via the second exhaust-system-cooling flow path 73. The cooling duct for the exhaust-manifold 32 is connected to the cooling duct for the turbocharger 33 via the third exhaust-system-cooling flow path 75. The cooling duct for the turbocharger 33 is connected to the cooling duct for the exhaust pipe 34 via the fourth exhaust-system-cooling flow path 77. The cooling duct for the exhaust pipe 34 is connected to the intake port of the fifth exhaust-system-cooling flow path 79 and the cooling water drainage port 80 at the rear end 79*a* of the drainage duct 79 is provided on the rear surface 11*b* of the vessel body 11 other than the portion immediately behind the saddle-riding type seat 29 (shown in FIG. 2).

Figure 5A:
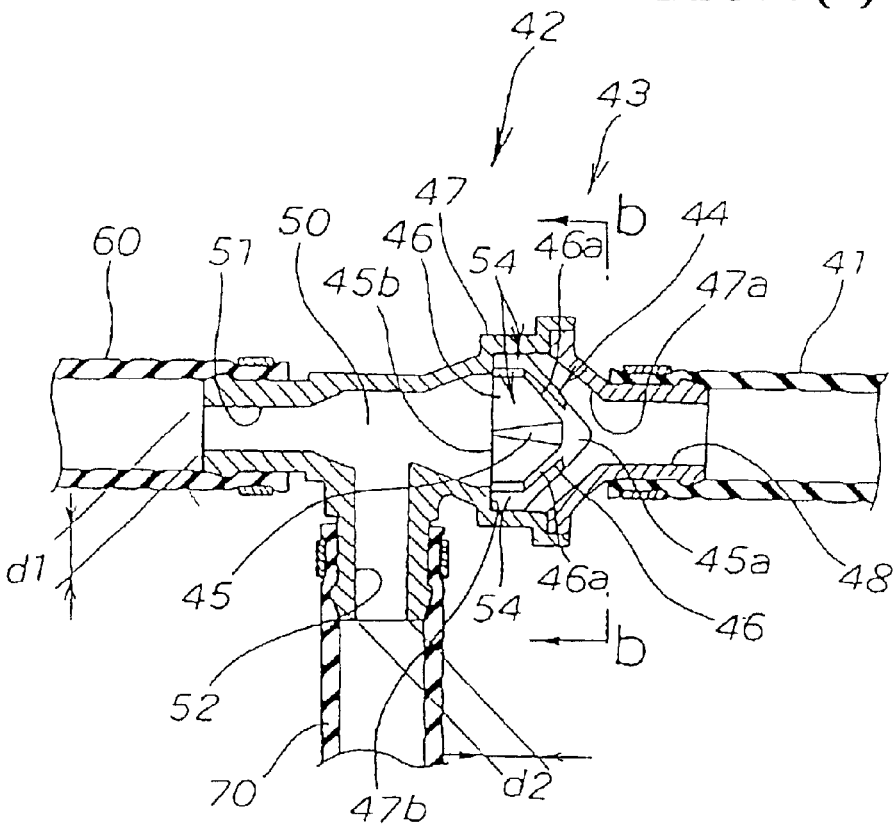
FIGS. 5(*a*) and 5(*b*) are cross sectional views of a one-way valve unit constituting the cooling system for a jet propulsion boat according to the present invention.
Figure 5B:
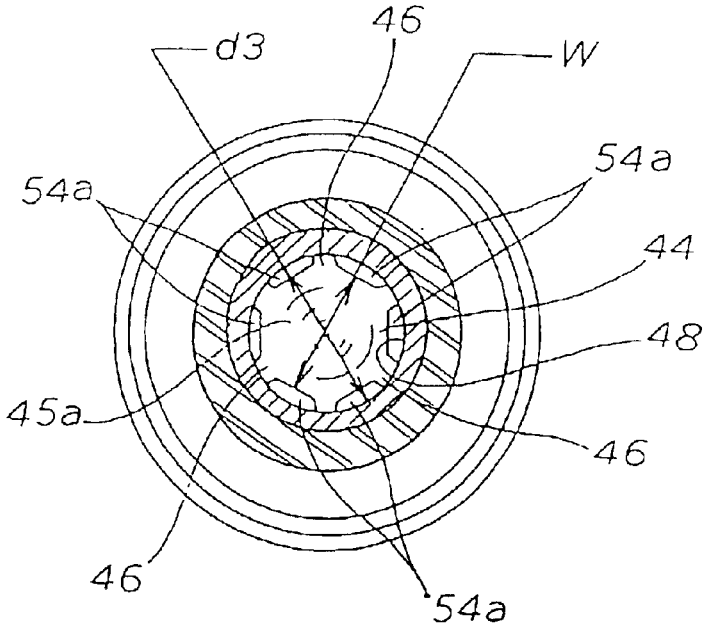

FIGS. 5(*a*) and 5(*b*) are cross sectional views showing the one-way valve unit constituting the cooling system for a jet propulsion boat according to the present invention. FIG. 5(*b*) is a cross sectional view taken along the line b-b of FIG. 5(*a*).

The one-way valve unit 42 comprises a valve body 44 of the one-way valve 43 in a casing 47, an inlet port 48 at the right end of the casing 47, and the first diverged outlet port 51 and the second diverged outlet port 52 at the left end thereof via the diverging path 50.

The valve body 44 is constructed in such a manner that the distal end 45*a* of the core portion 45 formed into the tapered conical shape. The core portion 45 is formed so as to be reduced in diameter gradually from the distal end 45*a* toward the proximal end 45*b*. A plurality of (six) blades 46 extend radially from the periphery of the core portion 45. Furthermore, the distal end surfaces 46*a* of the plurality of blades 46 are formed on the inclined surface being flush with the periphery of the distal end portions 45*a* in the conical shape.

The inlet port 48 of the casing 47 is to be connected to the outlet port of the inlet path 41. The first diverged outlet port 51 is to be connected to the engine-cooling flow path 60, and the second diverged outlet port 52 is to be connected to the exhaust-system-cooling flow path 70.

When cooling water flows from the inlet path 41 through the inlet port 48 to the valve body 44, the one-way valve 43 moves the valve body 44 away from the valve seat 47*a* by the hydraulic pressure of the cooling water and abuts against the shoulder 47*b*. As a consequence, the valve body 44 can remain stationary in a position away from the valve seat 47*a* (the state shown in FIG. 5(*a*)).

Since cooling water can flow through the spaces 54 between the blades 46 by keeping the valve body 44 away from the valve seat 47*a*, cooling water can flow from the inlet path 41 toward the diverging path 50.

On the other hand, when washing water flows from the first diverged outlet port 51 to the valve body 44, the one-way valve 43 moves the valve body 44 toward the valve seat 47*a* by the hydraulic pressure of the washing water, and presses the valve body 44 against the valve seat 47*a*.

Pressing the valve body 44 against the valve seat 47*a* prevents washing water flowing from the fist diverged outlet port 51 to the diverging path 50 from flowing into the inlet path 41.

The inner diameter d1 of the first diverged outlet port 51 is 8 mm as an example, and the inner diameter d2 of the second diverged outlet port 52 is 10 mm as an example. The relation between the inner diameter d1 and the inner diameter d2 is d1<d2.

As shown in FIG. 5(*b*), parts (fine flow paths) 54*a* of the spaces 54 between the blades 46 of the valve body 44 can be positioned in the inlet port 48 by determining the maximum width W of the distal end 45*a* of the valve body 44 to the value smaller than the inner diameter d3 of the inlet port 48. The inner diameter d3 may be 12 mm as an example.

With the valve body 44 thus constructed, fine flow paths 54*a* as "flow paths for allowing a small quantity of washing water to flow" may be provided between the valve seat 47*a* and the valve body 44 when the valve body 44 abuts against the valve seat 47*a*. Therefore, a small quantity of washing water from the washing water flowing from the first diverged outlet port 51 to the diverging path 50 may flow through the fine flow paths 54*a* to the side of the intake path 41.

As a consequence, the interior of the jet propulsion unit 20 (shown in FIG. 1) can be washed easily with a small quantity of washing water passed through the fine flow paths 54*a*. Therefore, washing of the jet propulsion boat 10 (shown in FIG. 1) can be performed efficiently without too much time and effort.

In addition, since the washing water passing through the fine flow paths 54*a* is in a small quantity, most of the cooling water used for cooling the engine-cooling flow path 60 can be supplied to the exhaust-system-cooling flow path 70. Therefore, the exhaust-system-cooling flow path 70 can be satisfactorily washed.

Figure 6:
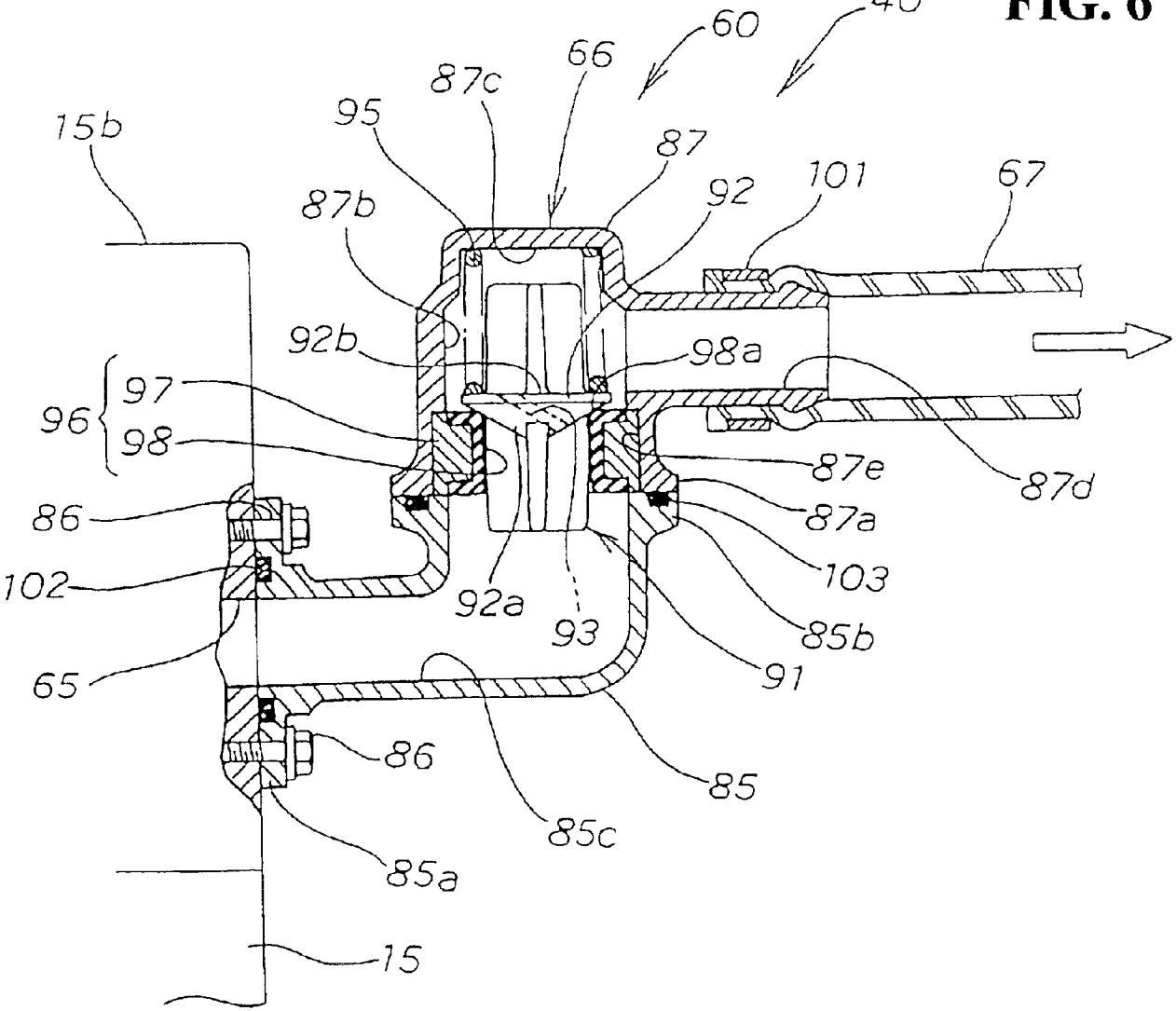
FIG. 6 is a cross sectional view of a flow regulating valve constituting the cooling system for a jet propulsion boat according to the present invention.

FIG. 6 is a cross sectional view of the flow regulating valve constituting the cooling system for a jet propulsion boat according to the present invention. The cooling system 40 for a jet propulsion boat comprises the flow regulating valve 66 in the engine-cooling flow path 60. The flow regulating valve 66 comprises an elbow casing 85 the lower flange portion 85*a* of which is fixed on the cylinder head 15*b* with bolts 86, 86. A body 87 includes a flange portion 87*a* which is fixed on the upper flange portion 85*b* of the elbow casing 85 with a bolt 88 (shown in FIG. 4). The valve body 91 is disposed in the storage section 87*b* in the body 87. A compression spring 95 is disposed between the valve body portion 92 formed at the center of the valve body 91 and the ceiling portion 87*c* of the body 87. A supporting ring 96 is provided for holding the valve body 91 in the body 87 against a urging force of the compression spring 95. Furthermore, a constantly opened flow path 93 is formed in the valve body portion 92.

In other words, the cooling system 40 for a jet propulsion boat is provided with the constantly opened flow path 93 having a constant cross section and the flow regulating valve 66 the valve body 91 of which opens when the primary pressure exceeds a predetermined value P in the engine-cooling flow path 60. The cooling system 40 is adapted to vary the cross sectional area of the engine-cooling flow path 60 by varying the opening of the opened valve body 91 in accordance with the primary pressure.

The flow regulating valve 66 can bring the intake port 85*c* of the elbow casing 85 into communication with the outlet port of the cylinder-head-cooling duct 65 (cooling water jacket) by mounting the lower flange portion 85*a* of the elbow casing 85 to the cylinder head 15*b* with the bolts 86, 86. The intake port 85*c* of the elbow casing 85 is in communication with the storage section 87*b* of the body 87 when the valve body 91 is opened. The intake port 85*c* is also in communication with the storage section 87*b* of the body 87 through the constantly opened flow path 93 even when the valve body 91 is closed.

The body 87 is provided with an outlet port 87*d* that communicates with the storage section 87*c*. The drainage duct 67 for cooling water for the engine is inserted into the outlet port 87*d* and the drainage duct 67 is fixed to the outlet port 87*d* with the band 101.

As a consequence, when the valve body 91 is opened, cooling water flowing into the intake port 85*c* of the elbow casing 85 from the cylinder-head-cooling duct 65 of the cylinder head 15*b* into the intake port 85*c* of the elbow casing 85 can flow into the drainage duct 67 via the storage section 87*b* and the outlet port 87*d* as shown by the arrow.

On the other hand, when the valve body 91 is closed, cooling water flowing into the intake port 85*c* of the elbow casing 85 from the cylinder-head-cooling duct 65 of the cylinder head 15*b* can flow into the constantly opened flow path 93. Cooling water passing through the constantly opened flow path 93 can flow into the drainage duct 67 via the storage section 87*b* and the outlet port 87*d* as shown by the arrow.

The reference numeral 102 designates an O-ring, and the O-ring 102 maintains a hermetic seal at the connecting portion between the cylinder head 15*b* and the lower flange portion 85*a* of the elbow casing 85.

The reference numeral 103 designates an O-ring. The O-ring 103 maintains a hermetic seal at the connecting portion between the upper flange portion 85*b* of the elbow casing 85 and the flange portion 87*a* of the body 87.

Figure 7:
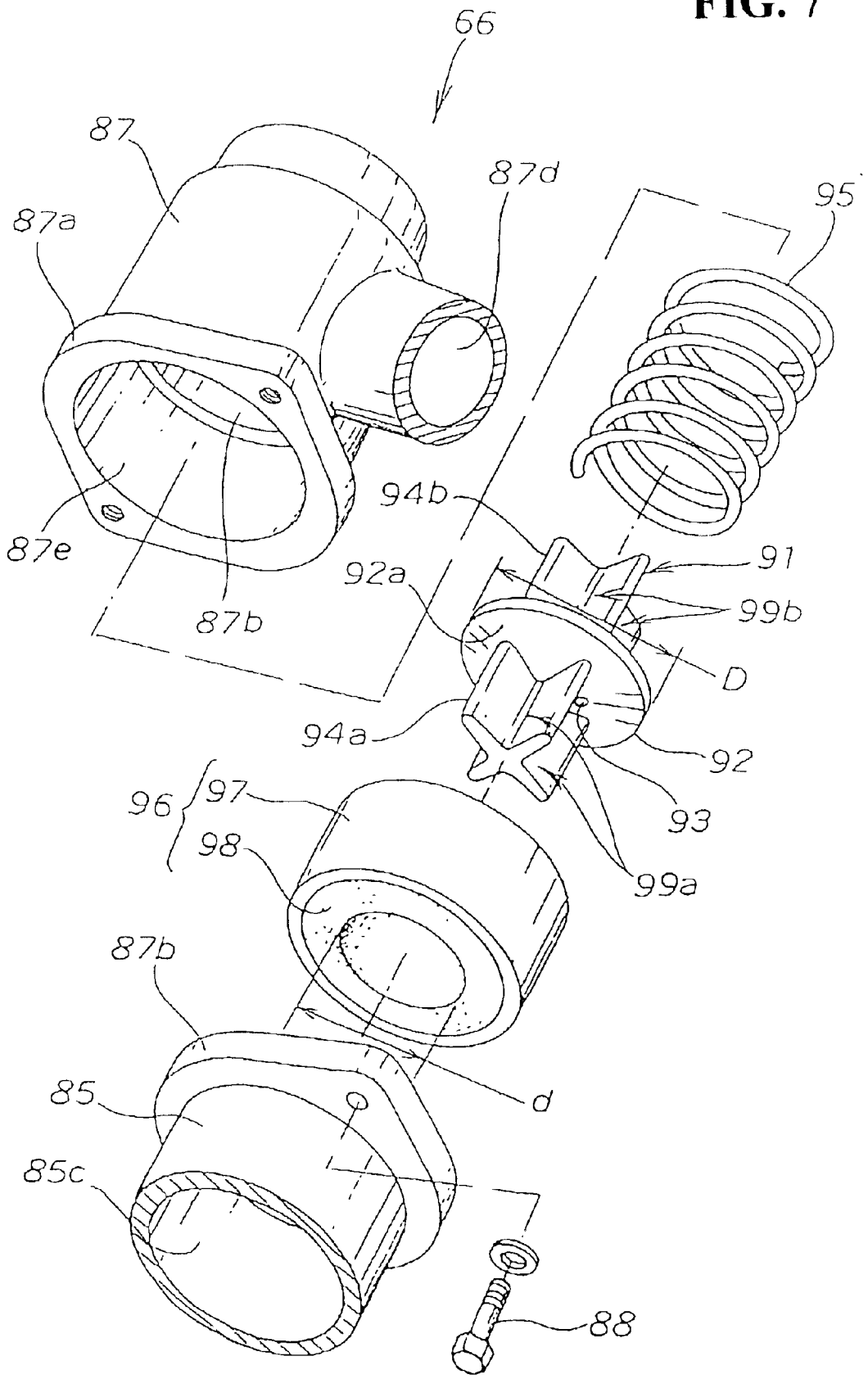
FIG. 7 is an exploded perspective view of the flow regulating valve constituting the cooling system for a jet propulsion boat according to the present invention.

FIG. 7 is an exploded perspective view of the flow regulating valve constituting the cooling system for a jet propulsion boat according to the present invention, showing a state in which the flow regulating valve 66 is disassembled into the elbow casing 85, the body 87, the valve body 91, the compression spring 95, and the supporting ring 96.

The supporting ring 96 is formed by fitting a collar 97 into the larger diameter portion 87*e* of the body 87 and mounting a packing 98 having substantially angular C-shaped cross section in the inner periphery of the collar 97.

The valve body 91 is provided with the valve body portion 92 at the center thereof, a lower rib portion 94*a* downwardly of the valve body portion 92, and an upper rib portion 94*b* upwardly of the valve body portion 92. The valve body portion 92 comprises a circularized periphery, a lower surface having a tapered surface 92*a* inclining upward from the center toward the periphery, and a constantly opened flow path 93 extending through the tapered surface 92*a* to the upper surface 92*b* (See FIG. 6).

In this case, determining the inner diameter d of the packing 98 constituting the supporting ring 96 to be smaller than the outer diameter D of the valve body portion 92 enables the inner corner portion 98*a* of the packing 98 (shown in FIG. 6) to be abutted against the tapered surface 92*a* of the valve body portion 92. In other words, the inner corner portion 98*a* of the packing 98 serves as a valve seat.

The lower rib portion 94*a* extending downward from the tapered surface 92*a* of the valve body portion 92 is formed substantially into the shape of a cross in cross section. The upper rib portion 94*b* extending upward from the upper surface of the valve body portion is formed substantially into the shape of a cross in cross section.

In this way, forming the lower rib portion 94*a* and the upper rib portion 94*b* into the shape of a cross in cross section secures the flow paths 99*a* in the lower rib portion 94*a* and the flow paths 99*b* in the upper rib portion 94*b*, so that cooling water can flow easily.

Referring back to FIG. 6, with the flow regulating valve 66 thus constructed, the tapered surface 92*a* of the valve body portion 92 is pressed against the inner corner portion 98*a* of the packing 98 of the supporting ring 96 to close the flow regulating valve 66 by urging the valve body portion 92 by the compression spring 95. Therefore, in this state, only the constantly opened flow path 93 communicates the intake port 85*c* and the outlet port 87*d* of the flow regulating valve 66. Since the constantly opened flow path 93 is a through hole of relatively small diameter with a constant cross sectional area, the volumetric flow of cooling water can be suppressed to a relatively small value.

On the other hand, when the hydraulic pressure on the side of the intake port 85*c* of the flow regulating valve 66 (hereinafter referred to as "primary pressure") exceeds a predetermined value P, the valve body 91 moves upward and the tapered surface 92*a* of the valve body portion 92 moves away from the packing 98 against an urging force of the compression spring 95. Accordingly, the flow regulating valve 66 can be released.

In addition, in a state in which the flow regulating valve 66 is released, the opening of the valve body 91 can be varied in accordance with variations in primary pressure. The flow regulating valve 66 is provided with a constantly opened flow path 93 having a constant cross sectional area in the engine-cooling flow path 60. The flow regulating valve 66 is adapted in such a manner that the valve body 91 is opened when the primary pressure exceeds a prescribed value p and the opening of the opened valve body 91 varies in accordance with the primary pressure.

As is described above, with the provision of the constantly opened flow path 93 having a constant cross sectional area in the engine-cooling flow path, cooling water flows through the constantly opened flow path 93 so that a relatively small quantity of cooling water flows into the engine-cooling flow path 60 in the low-revolution region of the engine in which the jet propulsion boat 10 shown in FIG. 1 is operating at idle.

On the other hand, the valve body 91 of the flow regulating valve 66 can be opened when the primary pressure exceeds the prescribed value P and the opening of the opened valve body 91 can be varied in accordance with the primary pressure. The terms "the primary pressure exceeds a prescribed value" mean that the number of engine revolutions is relatively large. In other words, the primary pressure increases and exceeds a prescribed value P by increasing the hydraulic pressure of a jet of water from the jet propulsion unit 20 (See FIG. 1) by increasing the number of engine revolutions to a relatively high value.

As a consequence, in the region in which the number of engine revolutions is relatively high (high-revolution region), the flow regulating valve 66 is opened to flow a relatively high volume of cooling water. Flowing a relatively high volume of cooling water enables the flow of cooling water by the quantity corresponding to the heat release value of the engine 15 (See FIG. 1), thereby enabling the engine 15 to be sufficiently cooled.

As is described thus far, with a simple structure being provided only with the constantly opened flow path 93 and the flow regulating valve 66, a preferable quantity of cooling water can be flown corresponding to the respective heat release values in the low-revolution region and the high-revolution region of the engine 15. In addition, since the constantly opened flow path 93 is provided in the valve body portion 92 of the flow regulating valve 66, the constantly opened flow path 93 may be assembled within the flow regulating valve 66. Therefore, it is not necessary to provide separate constantly opened flow paths 93 as individual other than in the flow regulating valve 66 in the engine-cooling flow path 60, and thus the structure can be simplified.

In addition, integrating the constantly opened flow path 93 in the flow regulating valve 66 enables cooling water passed through the constantly opened flow path 93 to be drained using the drainage duct 67 of the flow regulating valve 66. As a consequence, the drainage duct of the constantly opened flow path 93 can be commonly used as the drainage duct 67 of the flow regulating valve 66, whereby the number of drainage ducts may be reduced.

Figure 8A:
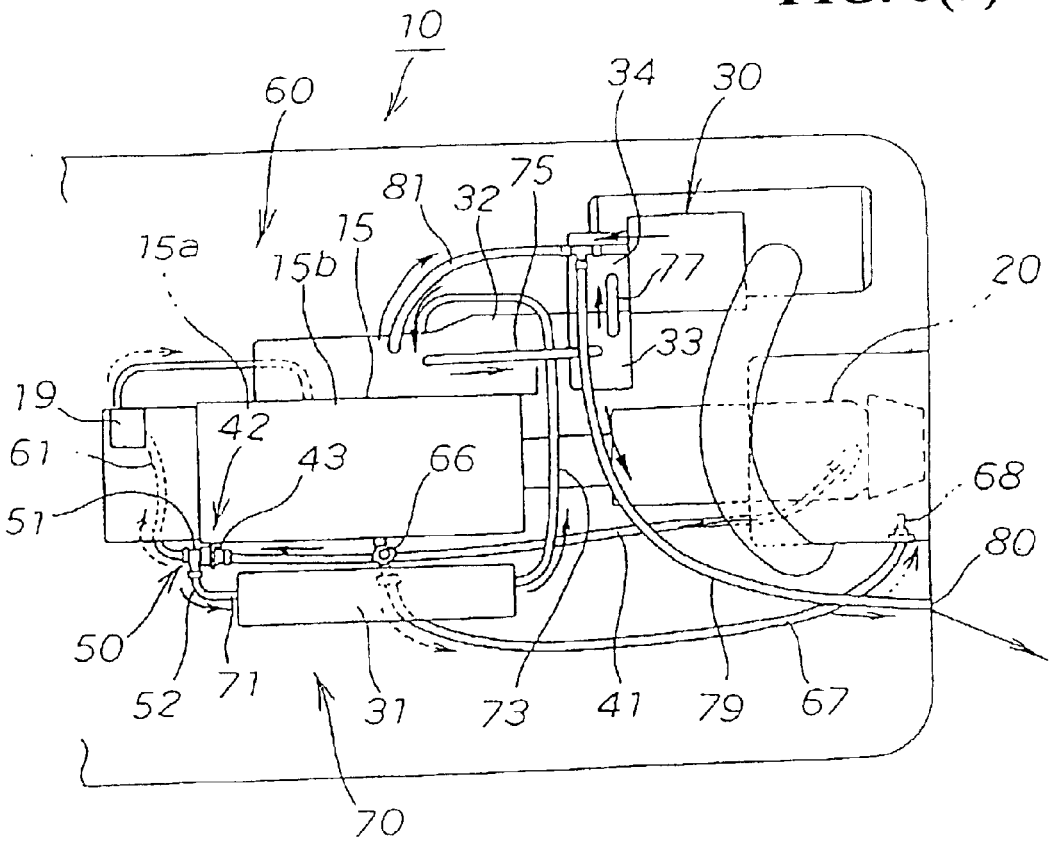
FIGS. 8(*a*) and 8(*b*) are first explanatory drawings illustrating the operation in an example in which the engine and the exhaust system are cooled by the cooling system for a jet propulsion boat according to the present invention.
Figure 8B:
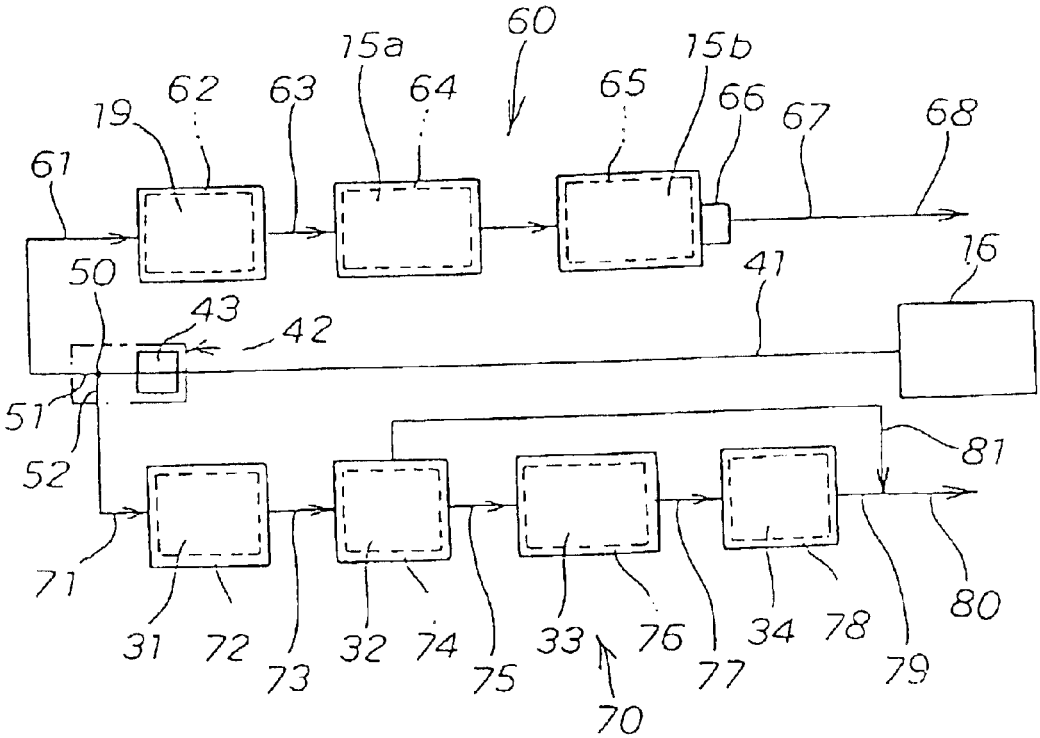

Subsequently, the operation of the cooling system for a jet propulsion boat will be described referring to FIG. 8 to FIG. 12. FIGS. 8(*a*) and 8(*b*) are first explanatory drawings illustrating the example of cooling the engine and the exhaust system with a cooling system for a jet propulsion boat according to the present invention.

When operating the jet propulsion boat 10, a part of the jet of water emitted from the jet propulsion unit 20 is introduced into the inlet path 41 as cooling water. Cooling water introduced into the inlet path 41 flows through the one-way valve 43 of the one-way valve unit 42 to the diverging path 50.

Cooling water flowing to the diverging path 50 is diverged to the first diverged outlet port 51 and the second diverged outlet port 52. Cooling water diverged into the first diverged outlet port 51 flows into the engine-cooling flow path 60. Furthermore, cooling water diverged into the second diverged outlet port 52 flows into the exhaust-system-cooling flow path 70.

Cooling water flowing into the engine-cooling flow path 60 flows through the first engine-cooling flow path 61 into the feed port of the oil-cooler-cooling duct 62, and flows from the feed port into the oil-cooler-cooling duct 62 and cools the oil cooler 19. Cooling water that is used for cooling the oil cooler 19 flows through the outlet port of the oil-cooler-cooling duct 62 and the second engine-cooling flow path 63 to the feed port of the cylinder-block-cooling duct 64, and flows from the feed port into the cylinder-block-cooling duct 64 and cools the cylinder block 15*a*.

Cooling water used for cooling the cylinder block 15*a* flows through the outlet port of the cylinder-block-cooling duct 64 to the feed port of the cylinder-head-cooling duct 65, and flows from the feed port into the cylinder-head-cooling duct 65 and cools the cylinder head 15*b*.

Cooling water used for cooling the cylinder head 15*b* flows from the outlet port of the cylinder-head-cooling duct 65 into the flow regulating valve 66, and cooling water passed through the flow regulating valve 66 flows into the drainage duct 67, and then flows through the drainage duct 67 and discharged from the cooling water outlet port 68 toward the outside. Consequently, the engine 15 is cooled by the cooling water.

On the other hand, cooling water flowing into the exhaust-system-cooling flow path 70 flows through the first exhaust-system-cooling flow path 71 to the feed port of the intercooler-cooling duct 72, and flows from the feed port into the intercooler-cooling duct 72 and cools the intercooler 31.

Cooling water used for cooling the intercooler 31 flows through the outlet port of the intercooler-cooling duct 72 and the second exhaust-system-cooling flow path 73 to the feed port of the exhaust-manifold-cooling duct 74, and flows from the feed port into the exhaust-manifold-cooling duct 74 and cools the exhaust manifold 32.

Cooling water used for cooling exhaust manifold 32 flows through the outlet port of the exhaust-manifold-cooling duct 74 and the third exhaust-system-cooling flow path 75 to the feed port of the turbocharger-cooling duct 76, and flows from the feed port into the turbocharger-cooling duct 76 and cools the turbocharger 33.

Cooling water used for cooling the turbocharger-cooling duct 76 flows through the outlet port of the turbocharger-cooling duct 76 and the fourth exhaust-system-cooling flow path 77 into the feed port of the exhaust-pipe-cooling duct 78, and flows from the feed port into the exhaust-pipe-cooling duct 78 and cools the exhaust pipe 34.

Cooling water used for cooling the exhaust pipe 34 flow into the outlet port of the exhaust-pipe-cooling duct 78 and the intake port of the fifth exhaust-system-cooling duct 79, and flows from the intake port through the drainage duct 79 and the cooling water outlet port 80 toward the outside. As a consequence, the exhaust system 30 is cooled by the cooling water.

Figure 9A:
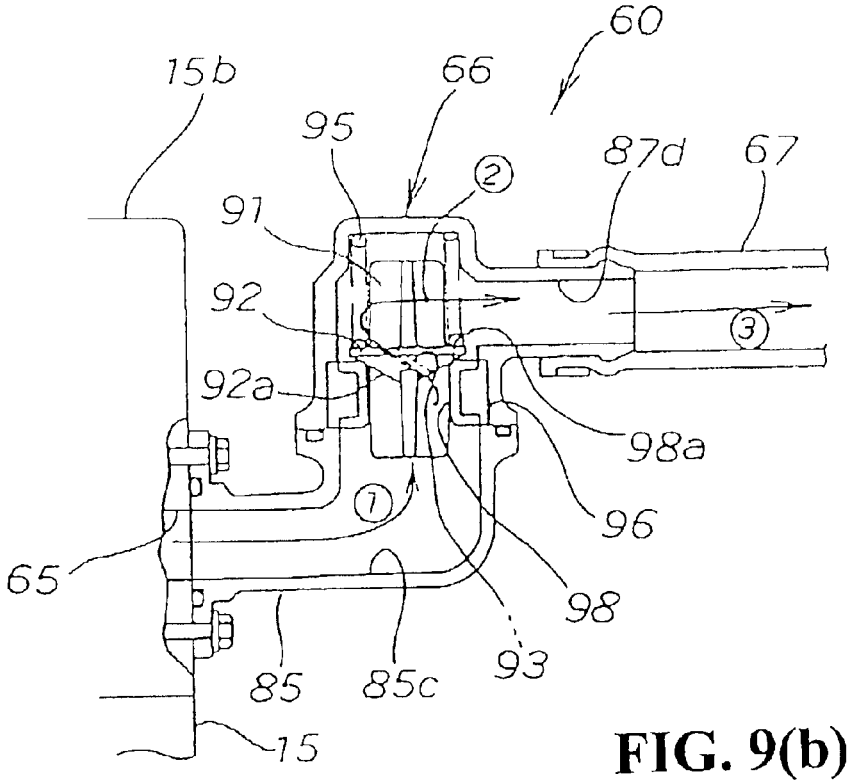
FIGS. 9(*a*) and 9(*b*) are second explanatory drawings illustrating the operation in an example in which the engine and the exhaust system are cooled by the cooling system for a jet propulsion boat according to the present invention.
Figure 9B:
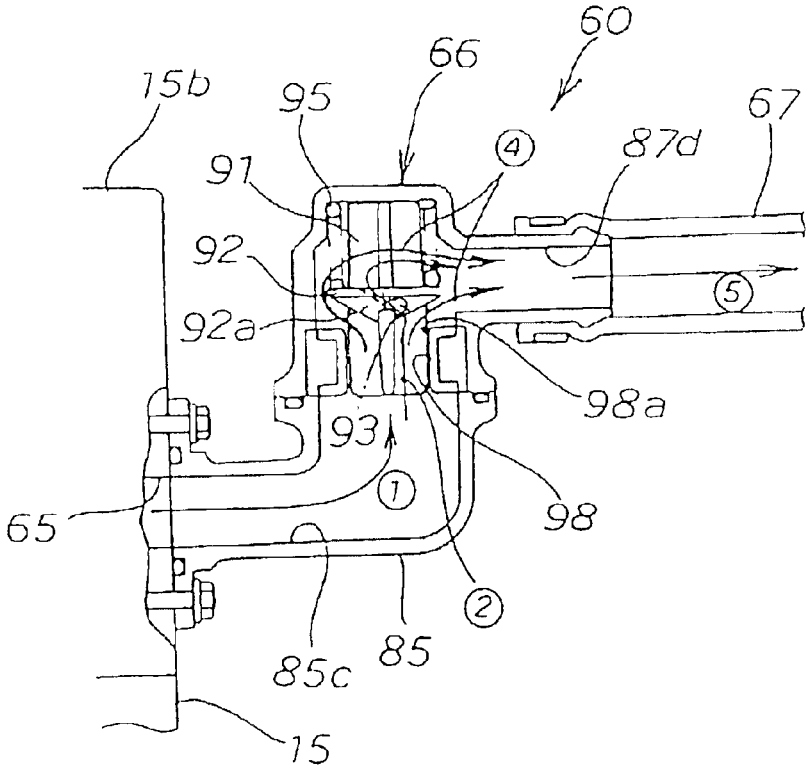

FIGS. 9(*a*) and 9(*b*) are second explanatory drawings illustrating an example in which the engine and the exhaust system is cooled by the cooling system for a jet propulsion boat according to the present invention. FIG. 9(*a*) shows an example in which the flow regulating valve 66 is closed, and FIG. 9(*b*) shows an example in which the flow regulating valve 66 is opened.

In FIG. 9(*a*), when the jet propulsion boat 10 shown in FIG. 1 is propelled in the low-revolution region in which the number of engine revolutions is relatively small, the number of revolution of the jet propulsion unit 20 is also small. Thus, the hydraulic pressure of a jet of water emitted from the jet propulsion unit 20 is relatively low. Therefore, the hydraulic pressure of cooling water flowing in the engine-cooling flow path 60, that is, the primary pressure is lower than the prescribed value P. Therefore, the flow regulating valve 66 is closed by pressing the tapered surface 92*a* of the valve body portion 92 of the valve body 91 against the inner corner portion 98*a* of the packing 98 by an urging force of the compression spring 95.

Accordingly, cooling water flowing into the intake port 85*c* of the flow regulating valve 66 from the outlet port of the cylinder-head-cooling duct 65 as shown by the arrow ②, and the cooling water flown therein passes through the constantly opened flow path 93 as shown by the arrow ② to the outlet port 87*d*. Subsequently, cooling water flown to the outlet port 87*d* is flown into the drainage duct 67.

Therefore, in the low-revolution region in which the number of engine revolutions is relatively small, a relatively small quantity of cooling water can be flown into the engine-cooling flow path 60. As a consequence, when the jet propulsion boat 10 is propelled in the low-revolution region including driving at idle, the engine 15 is prevented from being overcooled and thus the engine 15 can be properly cooled.

In FIG. 9(*b*), when the jet propulsion boat 10 shown in FIG. 1 is propelled in the high-revolution region in which the number of engine revolutions is relatively large, the number of revolutions of the jet propulsion unit 20 is also large. Thus the hydraulic pressure of a jet of water emitted from the jet propulsion unit 20 is relatively high. Therefore, the hydraulic pressure of cooling water flown in the engine-cooling flow path 60, that is, the primary pressure exceeds a prescribed value P.

Accordingly, the hydraulic pressure applied to the valve body 91 increases, and the valve body 91 is lifted upward against an urging force of the compression spring 95. Therefore, the tapered surface 92*a* of the valve body portion 92 constituting the valve body 91 is kept away from the inner corner portion 98*a* of the packing 98, so that the flow regulating valve 66 is released.

Accordingly, cooling water is flown from the outlet port of the cylinder-head-cooling duct 65 into the intake port 85*c* of the flow regulating valve 66 as shown by the arrow ①. The cooling water flowing therein is passed through the constantly opened flow path 93 as shown by the arrow ② and flows into the outlet port 87*d*. Simultaneously, the cooling water passes through the clearance between the valve body portion 92 and the packing 98 as shown by the arrow ④ and flows into the outlet port 87*d*.

Subsequently, the respective stream of cooling water flowing into the outlet port 87*d* through the respective routes are joined at the outlet port 87*d* and flow into the drainage duct 67 as shown by the arrow ⑤.

In this way, in the high-revolution region in which the number of engine revolutions is relatively large, cooling water can flow through two routes of the constantly opened flow path 93 and the clearance between the valve body portion 92 and the packing 98. Thus a relatively large volume of cooling water can flow into the engine-cooling flow path 60.

In addition, the flow regulating valve 66 can open the valve body 91 when the primary pressure exceeds the prescribed value P and vary the opening of the opened valve body 91 in accordance with the primary pressure. Therefore, when the jet propulsion boat 10 is propelled, cooling water can flow by the quantity corresponding to the heat release value of the engine 15 shown in FIG. 1 in the high-revolution region including the case where the engine is running in full power, whereby the engine 15 is properly cooled.

Figure 10A:
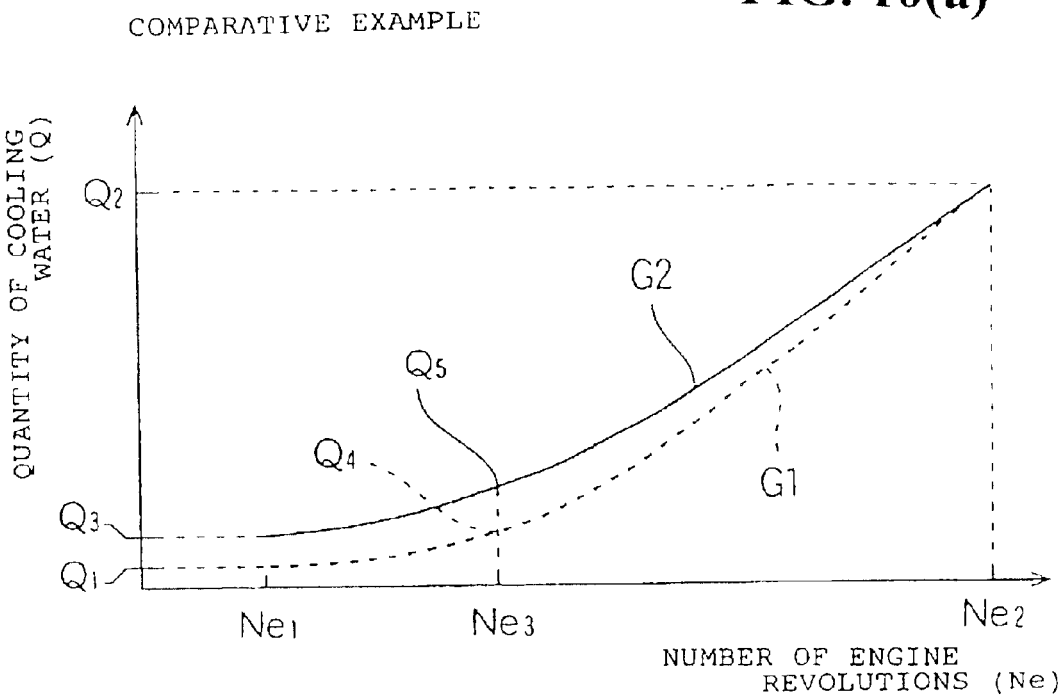
FIGS. 10(*a*) and 10(*b*) are graphs illustrating the relation between the cooling water flowing in the engine-cooling flow path and the number of engine revolutions in the cooling system for a jet propulsion boat according to the present invention.
Figure 10B:
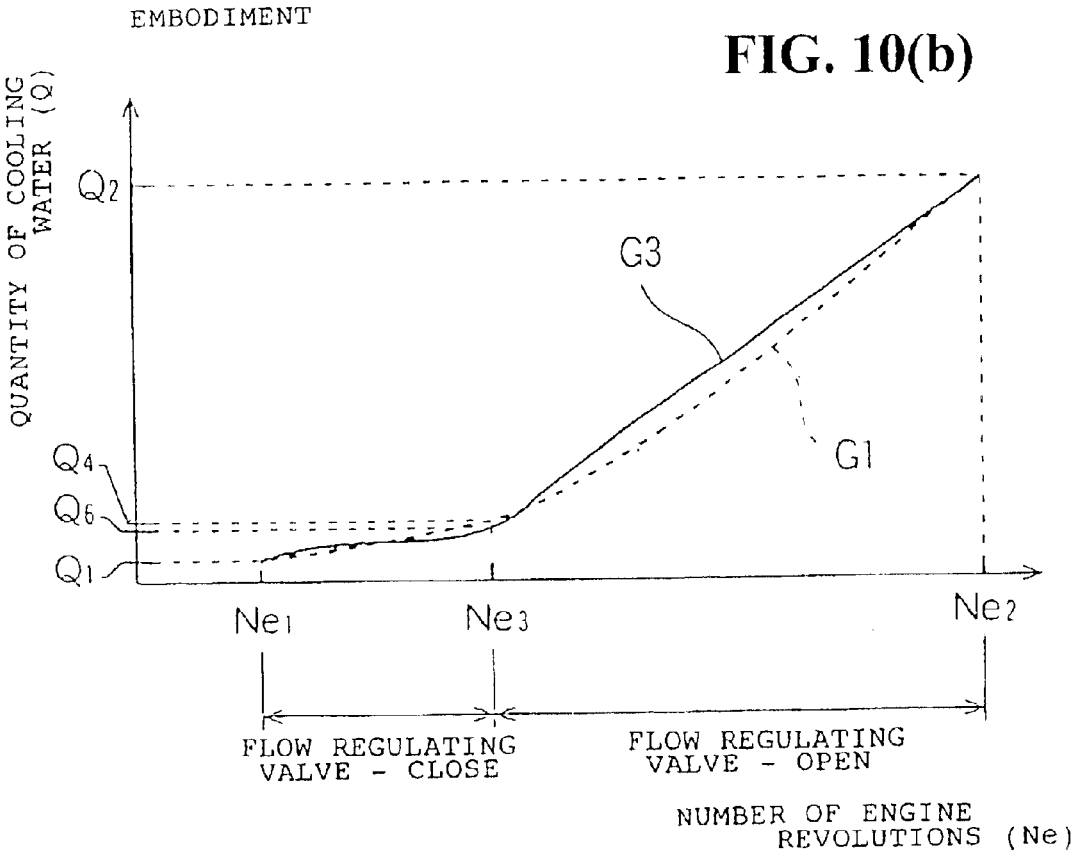

FIGS. 10(*a*) and 10(*b*) are graphs showing the relation between cooling water flowing in the engine-cooling flow path and the number of engine revolutions in the cooling system for a jet propulsion boat according to the present invention, in which FIG. 10(*a*) shows a curve of the quantity of cooling water in a state in which the flow regulating valve is not mounted as a comparative example. FIG. 10(*b*) shows a curve of the quantity of cooling water in a state in which the flow regulating valve is mounted as an embodiment.

In FIGS. 10(*a*) and 10(*b*), the vertical axis represents the quantity (Q) of cooling water flowing in the engine-cooling flow path 60. The horizontal axis represents the number of engine revolutions (Ne). The graph G1 shown by a broken line represents a curve of the ideal values, and G2 and G3 shown by solid lines represent curves of the actual values.

Generally, the jet propulsion boat 10 shown in FIG. 1 uses a part of a jet of water emitted from the jet propulsion unit 20 as cooling water for flowing in the engine-cooling flow path 60. The quantity of the jet of water varies in accordance with the number of revolutions of the engine 15.

In FIG. 10(*a*), when the jet propulsion boat 10 is propelled, the quantity of jet of water to be emitted increases as the number of revolutions of the engine 15 increases from driving at idle $Ne_1$ to running in full power $Ne_2$. Therefore, the quantity of cooling water varies in accordance with the number of revolutions of the engine 15.

On the other hand, the heat release value of the engine 15 can be held down to a relatively low value when the number of engine revolutions is small, but it increases as the number of engine revolutions increases. Therefore, it seems that cooling water can flow by the quantity corresponding to the heat release value of the engine 15 as shown in the graph G1 when a part of the jet of water emitted from the jet propulsion unit 20 is used as cooling water.

However, the quantity of cooling water when the jet propulsion boat 10 is actually propelled is as shown in the graph G2. In other words, when the quantity of cooling water Q is determined corresponding to the quantity of cooling water $Q_2$ required for the number of engine revolutions during full power driving $Ne_2$, the actual quantity of cooling water becomes larger as shown by $Q_5$ than the ideal quantity of cooling water $Q_4$ when the number of engine revolutions is lowered to the value $Ne_3$. In addition, even when the number of engine revolutions decreases to the value $Ne_1$, the actual quantity of cooling water is larger as shown by $Q_3$ than the ideal quantity of cooling water $Q_1$.

Therefore, when the quantity of cooling water Q is determined corresponding to the quantity of cooling water $Q_2$ for the case where the engine is running in full power, there is a possibility that the engine 15 comes into the state of being excessively cooled, that is, the overcooled state as the number of engine revolutions is lowered toward the state of driving at idle.

In FIG. 10(*b*), the flow regulating valve 66 is provided in the engine-cooling flow path 60 shown in FIG. 6. Thus the constantly opened flow path 93 having a constant cross sectional area is provided in the engine-cooling flow path 60. Furthermore, the flow regulating valve 66 is adapted to open when the primary pressure exceeds a prescribed value P, and to be able to vary the opening of the valve body 91 in accordance with the primary pressure. Consequently, the actual quantity of cooling water Q can flow as shown in the graph G3.

The graph G3 will be described in detail below. With the provision of the constantly opened flow path 93 having a constant cross sectional area in the engine-cooling flow path 60, cooling water flows through the constantly opened flow path 93 so that a relatively small quantity of cooling water is flown into the engine-cooling flow path 60 when the number of engine revolutions is in the low-revolution region between the number of engine revolutions $Ne_1$ during driving at idle and the number of engine revolutions $Ne_3$.

As a consequence, it is possible to match the actual quantity of cooling water Q in the state where the number of engine revolutions is $Ne_1$ as shown in the graph G3 with the ideal quantity of cooling water $Q_1$ shown in the graph G1, and thus the actual quantity of cooling water $Q_6$ in the state where the number of engine revolutions is $Ne_3$ can get close to the ideal quantity of cooling water $Q_4$. Therefore, when the number of engine revolutions is in the low-revolution region, the engine 15 is prevented from being overcooled, whereby the engine 15 is properly cooled.

On the other hand, with the provision of the flow regulating valve 66 in the engine-cooling flow path 60, the valve body 91 (See FIG. 6) is opened when the primary pressure exceeds a prescribed value P, and the opening of the opened valve body 91 varies in accordance with the primary pressure.

The terms "the primary pressure exceeds a prescribed value P" mean that the number of engine revolutions is relatively large, and a relatively large quantity of cooling water Q can be flown in the high-revolution region between the number of engine revolutions $Ne_3$ and the number of engine revolutions $Ne_2$ during running in full power.

Accordingly, as shown in the graph G3, it is possible to match the actual quantity of cooling water Q when the number of engine revolutions is the number of engine revolutions during running in full power $Ne_2$ with the ideal quantity of cooling water $Q_2$ shown in the graph G1. Therefore, even in the high-revolution region including the case where the engine is running in full power, cooling water can flow by the quantity corresponding to the heat release value of the engine 15, whereby the engine 15 is properly cooled.

Figure 11A:
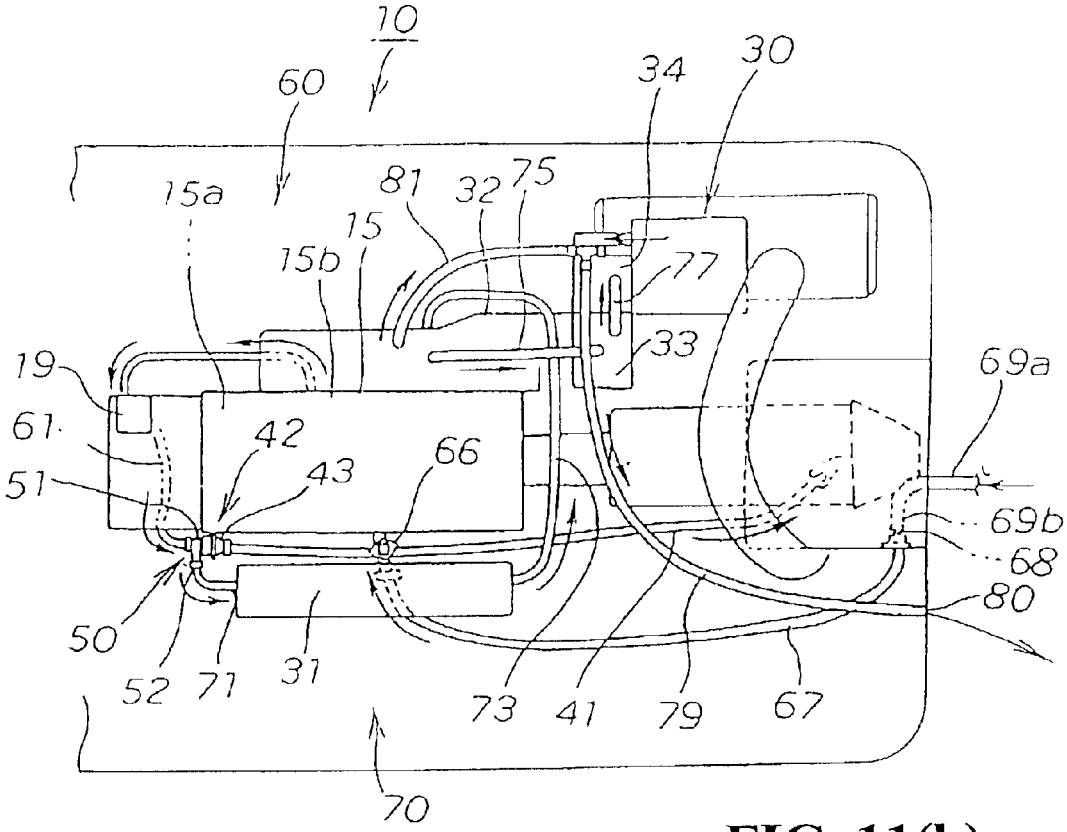
FIGS. 11(*a*) and 11(*b*) are first explanatory drawings illustrating the operation in an example in which the engine-cooling flow path and the exhaust-system-cooling flow path are washed by the cooling system for a jet propulsion boat according to the present invention.
Figure 11B:
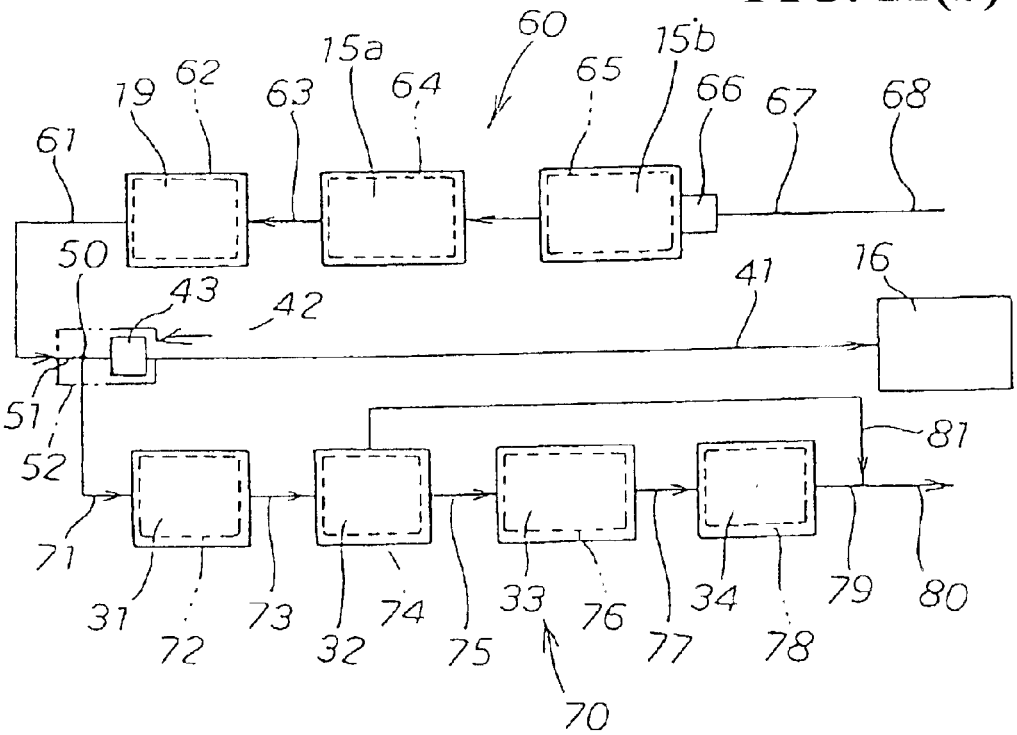

FIGS. 11(*a*) and 11(*b*) are first explanatory drawings illustrating the operation in an example in which the engine-cooling flow path and the exhaust-system-cooling flow path are washed by the cooling system for a jet propulsion boat according to the present invention.

A water hose 69*a* for supplying tap water (washing water) is attached to the cooling water outlet port 68. Washing water flows through the water hose 69*a* and the cooling water outlet port 68 to the drainage duct 67. Washing water flowing into the drainage duct 67 flows into the flow regulating valve 66, and is then passed through the constantly opened flow path 93 (Shown in FIG. 6) of the flow regulating valve 66. The washing water then flows into the cylinder-head-cooling duct 65 and washes the cylinder-head-cooling duct 65.

Washing water used for washing the cylinder-head-cooling duct 65 flows into the cylinder-block-cooling duct 64 and washes the cylinder-block-cooling duct 64. Washing water used for washing the cylinder-block-cooling duct 64 flows into the oil-cooler-cooling duct 62 through the second engine-cooling flow path 63 and washes the oil-cooler-cooling duct 62. Washing water used for washing the oil-cooler-cooling duct 62 flows into the first engine-cooling flow path 61 and then from the first engine-cooling flow path 61 through the first diverged outlet port 51 to the diverging path 50.

Most of cooling water that reached the diverging path 50 flows through the first exhaust-system-cooling flow path 71 to the feed port of the intercooler-cooling duct 72, and by flowing in the intercooler-cooling duct 72, the intercooler-cooling duct 72 is washed.

Washing water used for washing the intercooler-cooling duct 72 flows into the exhaust-manifold-cooling duct 74 through the second exhaust-system-cooling flow path 73 and washes the exhaust-manifold-cooling duct 74.

Washing water used for washing the exhaust-manifold-cooling duct 74 flows through the third exhaust-system-cooling flow path 75 to the turbocharger cooling duct 76, and washes the turbocharger cooling duct 76. Washing water used for washing the turbocharger cooling duct 76 flows through the fourth exhaust-system-cooling flow path 77 into the exhaust-pipe-cooling duct 78, and washes the exhaust-pipe-cooling duct 78.

Washing water used for washing the exhaust-pipe-cooling duct 78 flows to the intake port of the fifth exhaust-system-cooling duct 79, and then flows through the drainage duct 79 and the cooling water outlet port 80 to the outside.

On the other hand, a small quantity of washing water reached the diverging path 50 is flown through a fine flow paths 54*a* . . . of the one-way valve 43 (shown in FIG. 6(*b*)) to the side of the inlet path 41. Accordingly, the interior of the jet propulsion unit 20 can easily be washed with a small quantity of washing water that is passed thorough the fine flow paths 54*a*.

Figure 12:
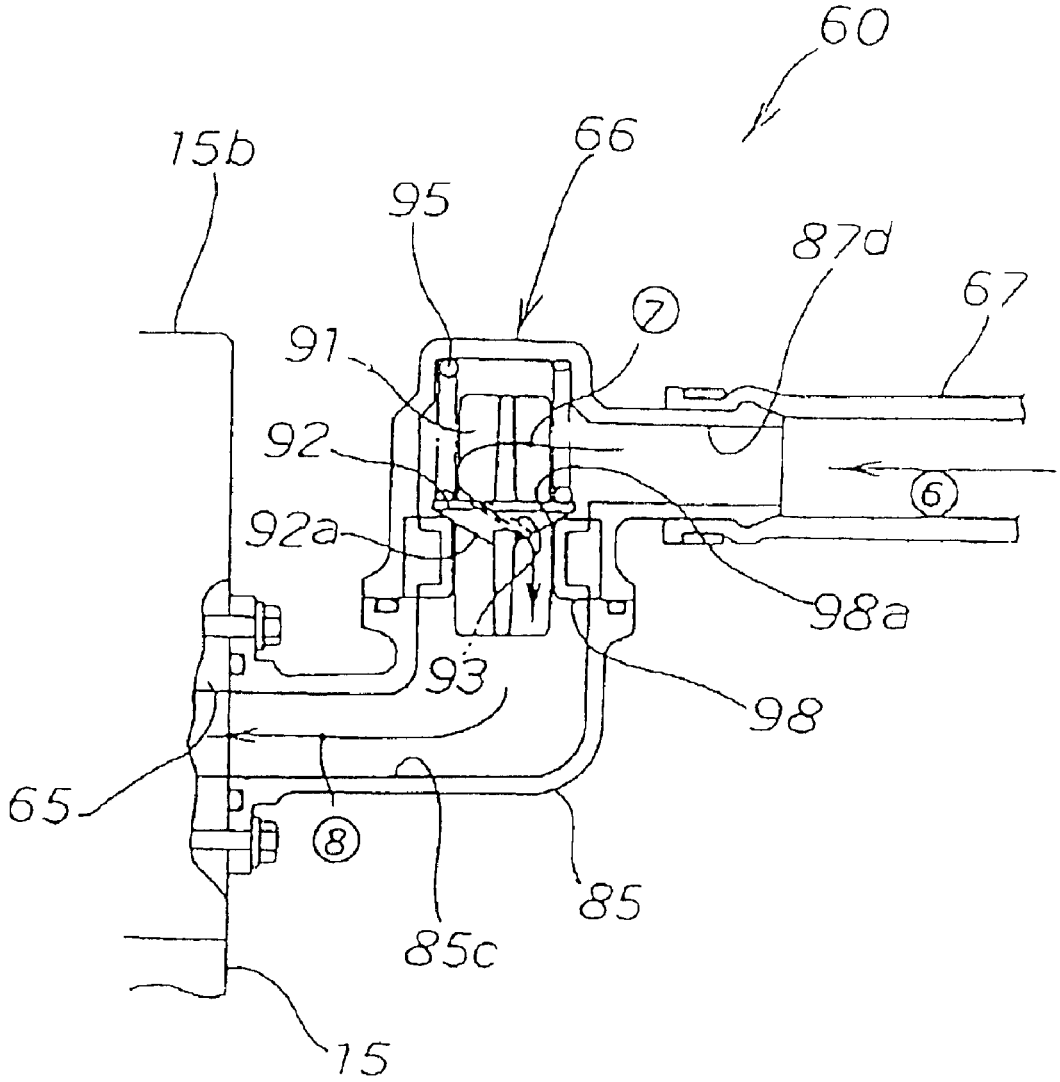
FIG. 12 is a second explanatory drawing illustrating the operation in an example in which the engine-cooling flow path and the exhaust-system-cooling flow path are washed by the cooling system for a jet propulsion boat according to the present invention.
Figure 13:
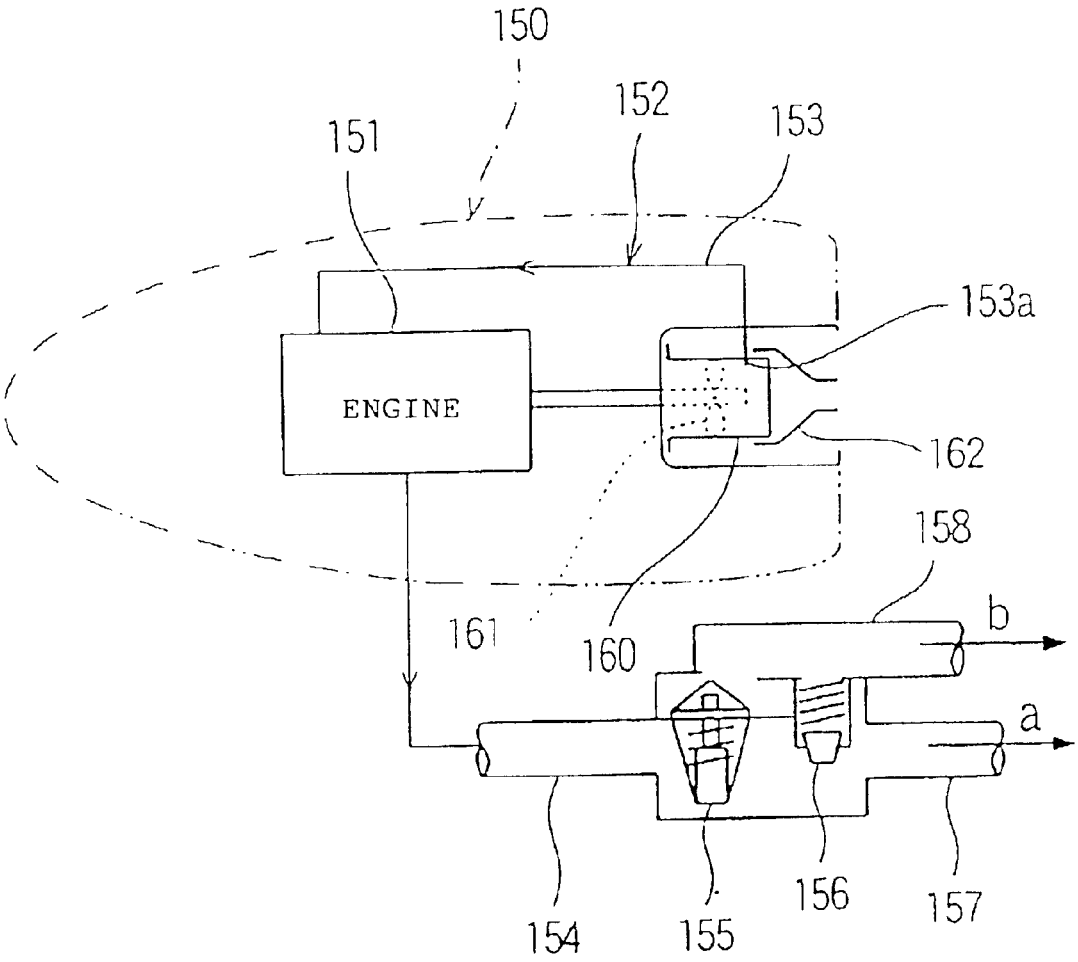
FIG. 13 BACKGROUND ART
FIG. 13 is a schematic view showing a principal portion of the cooling system for a jet propulsion boat in the background art.

FIG. 12 is a second explanatory drawing illustrating the operation in an example in which the engine-cooling flow path and the exhaust-system-cooling flow path are washed by the cooling system for a jet propulsion boat according to the present invention, showing a state in which cooling water is flown through the flow regulating valve 66.

The flow regulating valve 66 is maintained in a state in which the tapered surface 92*a* of the valve body portion 92 constituting the valve body 91 is pressed against the inside corner portion 98*a* of the packing 98 by a urging force of the compression spring 95.

Therefore, when washing water is flown from the drainage duct 67 to the outlet port 87*d* of the flow regulating valve 66 as shown by the arrow ⑥, washing water passes through the constantly opened flow path 93 of the flow regulating valve 66 as shown by the arrow ⑦.

Accordingly, the washing water passed through the constantly opened flow path 93 flows through the intake port 85*c* of the flow regulating valve 66 into the cylinder-head-cooling duct 65 of the cylinder head 15*b* (See also FIG. 11).

In the aforementioned embodiment, a cooling system for jet propulsion boat including two cooling flow paths, that is, the engine-cooling flow path 60 and the exhaust-system-cooling flow path 70 has been described as an example. However, it is also possible to construct the cooling system for a jet propulsion boat to have only one cooling flow path, that is, the engine-cooling flow path 60.

In the aforementioned embodiment, an example in which the flow regulating valve 66 is provided with a single constantly opened flow path 93 has been described. However, the number of the constantly opened flow paths 93 may be determined to any number. In addition, the diameter of the hole of the constantly opened flow path 93 may be determined arbitrarily.

In addition, in the aforementioned embodiment, an example in which the flow regulating valve 66 is adapted in such a manner that after the valve body 91 is opened, the opening of the opened valve body 91 varies in accordance with the primary pressure has been described. However, it is not limited thereto, and is possible to fully open the valve body 91 when the primary pressure exceeds the prescribed value P.

In the aforementioned embodiment, an example in which the oil cooler 19, the cylinder block 15*a*, and the cylinder head 15*b* are cooled by the engine-cooling flow path 60, and the intercooler 31, the exhaust manifold 32, the turbocharger 33 and the exhaust pipe 34 are cooled by the exhaust-system-cooling flow path 70 has been described. However, the components to be cooled are not limited thereto, and may be determined as appropriate depending on the construction of the jet propulsion boat 10.

The present invention constructed as described above exercises the following effects.

According to the first aspect of the present invention, the engine-cooling flow path is provided with a constantly opened flow path having a constant cross sectional area, and a flow regulating valve that opens when the primary pressure exceeds the prescribed value and changes the opening of the valve in accordance with the primary pressure. As is described above, with the provision of the constantly opened flow path having a constant cross sectional area in the engine-cooling flow path, cooling water is flown through the constantly opened flow path so that a relatively small quantity of cooling water is flown into the engine-cooling flow path in the region close to a state in which the engine is running at idle.

As a consequence, overcooling of the engine in the region in which the number of engine revolution is relatively small such as the state of driving at idle (low-revolution region) is prevented, whereby the engine is properly cooled.

On the other hand, with the provision of the flow regulating valve in the engine-cooling flow path, the valve body is opened when the primary pressure exceeds a prescribed value, and the opening of the opened valve body varies in accordance with the primary pressure. The terms "the primary pressure exceeds a prescribed value" mean that the number of engine revolutions is relatively large. In other words, the primary pressure increases to the value exceeding a prescribed value by increasing the number of engine revolutions to the relatively high value and thus increasing the hydraulic pressure of a jet of water from the jet propulsion unit.

As a consequence, in the region in which the number of engine revolutions is relatively large (high-revolution region), a relatively large quantity of cooling water can be flown by opening the flow regulating valve. Flowing a relatively large quantity of cooling water enables to flow an adequate quantity of cooling water corresponding to the heat release value of the engine, whereby the engine is preferably cooled.

As is described thus far, with a simple structure in which only the constantly opened flow path and the flow regulating valve are provided in the engine-cooling flow path, a preferable quantity of cooling water can be flown corresponding to the respective heat release values in the low-revolution region and the high-revolution region, and thus the number of components can be reduced and thus the cost can be lowered.

In addition, reduction of the number of components contribute to simplify the construction and to reduce assembling time, thereby improving productivity.

According to the second aspect of the present invention, since the constantly opened flow path is provided in the valve body of the flow regulating valve, the constantly opened flow path may be assembled within the flow regulating valve. Therefore, it is not necessary to provide separate constantly opened flow paths as individual other than in the flow regulating valve, and thus the structure can be simplified.

In addition, integrating the constantly opened flow path in the flow regulating valve enables cooling water passed through the constantly opened flow path to be drained using the drainage duct of the flow regulating valve. As a consequent, since the drainage duct of the constantly opened flow path can be commonly used as the drainage duct of the flow regulating valve, the number of the drainage ducts may be reduced and thus the structure can further be simplified.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A jet propulsion boat, comprising:

a vessel body:

a jet propulsion unit, said jet propulsion unit being provided at a rear portion of said vessel body;

an engine, said jet propulsion unit being driven by the engine to emit a jet of water for propelling the boat;

an engine cooling flow path, said engine being cooled by flowing a part of the jet of water in said engine-cooling flow path as cooling water, said engine-cooling flow path comprising:

a flow regulating valve that opens a valve body thereof en a primary pressure exceeds a prescribed value; and, a constantly opened flow path provided in said engine-cooling flow path and having a constant cross sectional area from an upstream side to a downstream side of the flow regulating valve, wherein a cross sectional area of said engine-cooling flow path is varied by varying the opening of the valve body according to the primary pressure, wherein the constantly opened flow path is provided in parallel with the flow regulating valve, and said constantly opened flow path allows unobstructed flow therethrough from the upstream side to the downstream side of the flow regulating valve when the flow regulating valve is in an open position and a closed position.

2. The jet propulsion boat according to claim 1, wherein the constantly opened flow path is provided in the valve body of the flow regulating valve.

3. The jet propulsion boat according to claim 2, wherein said engine-cooling flow path includes an oil-cooler-cooling-duct, an cylinder-bIock-cooling-duct, and a cylinder head cooling duct for respectively cooling an oil cooler, a cylinder block and a cylinder head of said engine.

4. The jet propulsion boat according to claim 2, further comprising an exhaust-cooling flow path, an exhaust system of the jet propulsion boat being cooled by flowing a part of the jet of water in said exhaust-cooling flow path as cooling water.

5. The jet propulsion boat according to claim 4, further comprising:

an inlet path, said inlet path being in communication with a jet pump chamber of said jet propulsion unit for flowing a part of the jet of water therethrough;

a diverging path, said diverging path being in communication with said engine-cooling flow path and said exhaust-cooling flow path for flowing said part o the jet of water through said engine-cooling flow path to cool said engine and said exhaust-cooling flow path to cool said exhaust system.

6. The jet propulsion boat according to claim 1, wherein said engine-cooling flow path includes an oil-cooler-cooling-duct, an cylinder-block-cooling-duct, and a cylinder head cooling duct for respectively cooling an oil cooler, a cylinder block and a cylinder head of said engine.

7. The jet propulsion boat according to claim 1, further comprising an exhaust-cooling flow path, an exhaust system of the jet propulsion boat being cooled by flowing a part of the jet of water in said exhaust-cooling flow path as cooling water.

8. The jet propulsion boat according to claim 7, wherein said exhaust-cooling flow path includes an intercooler-cooling-duct, an exhaust manifold-cooling-duct, a turbocharger-cooling duct and an exhaust-pipe cooling duct for respectively cooling an intercooler, and exhaust manifold, a turbocharger and an exhaust pipe of the jet propulsion boat.

9. The jet propulsion boat according to claim 7, further comprising:

an inlet path, said inlet path being in communication with a jet pump chamber of said jet propulsion unit for flowing a part of the jet of water therethrough;

a diverging path, said diverging path being in communication with said engine-cooling flow path and said exhaust-cooling flow path for flowing said part of the jet of water through said engine-cooling flow path to cool said engine and said exhaust-cooling flow path to cool said exhaust system.

10. The jet propulsion boat according to claim 1, wherein the constantly opened flow path is provided in the valve body of the flow regulating valve.

11. The jet propulsion boat according to claim 1, wherein the constantly opened flow path is provided in a movable portion of the flow regulating valve.

12. A cooling system for a jet propulsion boat, the jet propulsion boat including a vessel body, a jet propulsion unit provided at rear portion of the vessel body and an engine for driving the jet propulsion unit to emit jet of water for propelling the jet propulsion boat, said cooling system comprising:

an engine cooling flow path, the engine of the jet propulsion boat being cooled by flowing a part of the jet of water from the jet propulsion unit in said engine-cooling flow path as cooling water, said engine-cooling flow path comprising:

a flow regulating valve that opens a valve body thereof when a primary pressure exceeds a prescribed value; and a constantly opened flow path provided in said engine-cooling flow path and having a constant cross sectional area from an upstream side to a downstream side of the flow regulating valve, wherein a cross sectional area of said engine-cooling flow path is varied by varying the opening of the valve body according to the primary pressure, and wherein the constantly opened flow path is provided in parallel with the flow regulating valve, and said constantly opened flow path allows unobstructed flow there through from the upstream side to the downstream side of the flow regulating valve when the flow regulating valve is in an open position and a closed position.

13. The cooling system for a jet propulsion boat according to claim 12, wherein the constantly opened flow path is provided in the valve body of the flow regulating valve.

14. The cooling system for a jet propulsion boat a according to claim 13, wherein said engine-cooling flow path includes an oil-cooler-cooling-duct, an cylinder-block-cooling-duct, and a cylinder head cooling duct for respectively cooling an oil cooler, a cylinder block and a cylinder head of the engine.

15. The cooling system for a jet propulsion boat according to claim 13, further comprising an exhaust-cooling flow path, an exhaust system of the jet propulsion boat being cooled by flowing a part of the jet of water in said exhaust-cooling flow path as cooling water.

16. The cooling system for a jet propulsion boat according to claim 15, further comprising:

an inlet path, said inlet path being in communication with ajet pump chamber of the jet propulsion unit for flowing a part of the jet of water therethrough;

a diverging path, said diverging path being in communication the said engine-cooling flow path and said exhaust-cooling flow path for flowing said part the jet of water through said engine-cooling flow path to cool the engine and said exhaust-cooling flow path to cool the exhaust system.

17. The cooling system for a jet propulsion boat a according to claim 12, wherein said engine-cooling flow path includes an oil-cooler-cooling-duct, an cylinder-block-cooling-duct, and a cylinder head cooling duct for respectively cooling an oil cooler, a cylinder block and a cylinder head of the engine.

18. The cooling system for a jet propulsion boat a according to claim 12, further comprising an exhaust-cooling flow path, an exhaust system of the jet propulsion boat being cooled by flowing a part of the jet of water in said exhaust-cooling flow path as cooling water.

19. The cooling system for a jet propulsion boat according to claim 18, wherein said exhaust-cooling flow path includes an intercooler-cooling- duct, an exhaust manifold-cooling-duct, a turbocharger-cooling duct and an exhaust-pipe cooling duct for respectively cooling an intercooler, and exhaust manifold, a turbocharger and an exhaust pipe of the jet propulsion boat.

20. The cooling system for a jet propulsion boat according to claim 18, further comprising:

an inlet path, said inlet path being in communication with a jet pump chamber of the jet propulsion unit for flowing a part of the jet of water therethrough;

a diverging path, said diverging path being in communication with said engine-cooling flow path and said exhaust-cooling flow path for flowing said part f the jet of water through said engine-cooling flow path to cool the engine and said exhaust-cooling flow path to cool the exhaust system.

21. The cooling system for a jet propulsion boat according to claim 12, wherein the constantly opened flow path is provided in the valve body of the flow regulating valve.

22. The cooling system for a jet propulsion boat according to claim 12, wherein the constantly opened flow path is provided in a movable port on of the flow regulating valve.

23. A cooling system for a jet propulsion boat, the jet propulsion boat including a vessel body, a jet propulsion unit provided at rear portion of the vessel body and an engine for driving the jet propulsion unit to emit jet of water for propelling the jet propulsion boat, said cooling system comprising:

an engine cooling flow path, the engine of the jet propulsion boat being cooled by flowing a part of the jet of water from the jet propulsion unit in said engine-cooling flow path as cooling water;

a flow regulating valve that opens a valve body thereof when a primary pressure exceeds a prescribed value, a cross sectional area of said engine-cooling flow path being varied by varying the opening of the valve body according to the primary pressure; and a constantly opened flow path having a constant cross section area from an upstream side to a downstream side of the flow regulating valve, said constantly opened flow path allowing unobstructed flow of water therethrough from an upstream side to a downstream side of the flow regulating valve when the flow regulating valve is in an open position and closed position.

24. The cooling system for a jet propulsion boat according to claim 23 wherein the constantly opened flow path is provided in the valve body of the flow regulating valve.

25. The cooling system for a jet propulsion boat according to claim 23, wherein the constantly opened flow path is provided in a movable portion of the flow regulating valve.

26. The cooling system for a jet propulsion boat according to claim 23, wherein the constantly opened flow path is provided in the valve body of th flow regulating valve.

* * * * *